US008708867B2

(12) United States Patent
Lumsden et al.

(10) Patent No.: US 8,708,867 B2
(45) Date of Patent: Apr. 29, 2014

(54) EXERCISE METHODS AND APPARATUS SIMULATING STAND-UP PADDLE BOARDING

(75) Inventors: Charlie Lumsden, Kula, HI (US); Daniel Lee Bizzell, Charlotte, NC (US); Karl Christopher Gabriel, Charlotte, NC (US); Arthur Allen Henson, Charlotte, NC (US); Thomas James Philpott, Charlotte, NC (US); Michael Starkey, Charlotte, NC (US)

(73) Assignee: Season 4, LLC, Charlotte, NC (US)

( * ) Notice: Subject to any disclaimer, the term of this patent is extended or adjusted under 35 U.S.C. 154(b) by 126 days.

(21) Appl. No.: 13/429,162

(22) Filed: Mar. 23, 2012

(65) Prior Publication Data

US 2013/0225374 A1 Aug. 29, 2013

Related U.S. Application Data

(63) Continuation-in-part of application No. 13/406,529, filed on Feb. 27, 2012, now abandoned.

(51) Int. Cl.
*A63B 69/06* (2006.01)

(52) U.S. Cl.
USPC ..... 482/72; 482/71; 482/73

(58) Field of Classification Search
USPC ..... 482/1–9, 51, 71–73, 146
See application file for complete search history.

(56) References Cited

U.S. PATENT DOCUMENTS

| | | | | |
|---|---|---|---|---|
| 4,469,325 | A | 9/1984 | Ware | |
| 4,880,224 | A | 11/1989 | Jonas et al. | |
| 4,884,800 | A | 12/1989 | Duke | |
| 4,940,227 | A * | 7/1990 | Coffey | 482/73 |
| 5,328,427 | A * | 7/1994 | Sleamaker | 482/71 |
| 5,382,210 | A | 1/1995 | Rekers | |
| D367,508 | S | 2/1996 | Dreissigacker et al. | |
| 5,707,322 | A | 1/1998 | Dreissigacker et al. | |
| 5,916,069 | A | 6/1999 | Wang et al. | |

(Continued)

FOREIGN PATENT DOCUMENTS

| | | |
|---|---|---|
| EP | 0360827 B1 | 4/1992 |
| WO | 03013661 | 2/2003 |
| WO | 2013130114 | 9/2013 |

OTHER PUBLICATIONS

"International Search Report" and "Written Opinion of the International Search Authority" (FIPS) in Season 4 et al., International Patent Application Serial No. PCT/US2012/032316, dated Nov. 29, 2012, 6 pages.

(Continued)

*Primary Examiner* — Glenn Richman
(74) *Attorney, Agent, or Firm* — Tillman Wright, PLLC; Chad D. Tillman

(57) ABSTRACT

An exercise apparatus includes a frame; a platform configured to receive a person in a standing position, the platform connected to the frame; a handheld component configured to be held by a person standing on the platform; and an impeller-driven fluid circulation system. Manipulation of the handheld component by a person standing on the platform results in driving of the impeller and circulation of fluid within the fluid circulation system. The platform may rock from side to side, whereby a person standing on the platform must maintain balance while manipulating the handheld component. The handheld component may simulate a paddle and may include an elongate shaft. In this respect, the paddle component is used by a person standing on the platform as if the paddle component were a paddle used in paddleboarding, including manipulating the paddle component through a rowing motion that preferably would be experienced when actually paddleboarding.

17 Claims, 36 Drawing Sheets

(56) References Cited

U.S. PATENT DOCUMENTS

| | | | | |
|---|---|---|---|---|
| 6,106,436 | A | 8/2000 | Lundahl | |
| 7,374,522 | B2 | 5/2008 | Arnold | |
| 7,628,739 | B2 | 12/2009 | Gearon | |
| 7,686,751 | B2 * | 3/2010 | Carlson et al. | 482/146 |
| 7,731,637 | B2 | 6/2010 | D'Eredita | |
| 7,862,484 | B1 | 1/2011 | Coffey | |
| 2001/0003110 | A1 | 6/2001 | Lay | |
| 2005/0101450 | A1 | 5/2005 | Gramaccioni | |
| 2009/0036276 | A1 | 2/2009 | Loach | |
| 2009/0105057 | A1 * | 4/2009 | Carlson et al. | 482/146 |
| 2010/0248906 | A1 | 9/2010 | D'Eredita | |
| 2011/0275489 | A1 | 11/2011 | Apau | |
| 2013/0017934 | A1 * | 1/2013 | Tayebi | 482/129 |
| 2013/0225375 | A1 | 8/2013 | Lumsden et al. | |

OTHER PUBLICATIONS

First Degree Fitness North America—Fluid Resistance Technology Fitness Equipment. file:///M:/Firm%20 -%20Clients/01000-02000/1708%20-%20Season%204/1708.050—Stand-up%20Row/1708.050%20References/First%20Degree%20Fitness%20North%20America%20%20%20Fluid%20Resistance%20Technology%20Fitness% 20Equipment.htm, accessed Apr. 4, 2012, 1 page.

Generation 1 Stand Up Paddle Trainer at Blue Planet Surf at Stand Up Paddle Surfing in Hawaii—StandUpPaddleSurf. www.standup-paddlesurf.net/2010/09/29/stand-up-paddle-trainer-at blue-planet-surf-2/ , accessed Apr. 4, 2012, 14 pages.

Stand Up Paddle Trainer Version 2 at Blue Planet Surf at Stand Up Paddle Surfing in Hawaii-StandUpPaddleSurf. www.standup-paddlesurf.net/2011/05/26/stand-up-paddle-trainer-version-2-at-blue-planet-surf/ , accessed Apr. 4, 2012, 11 pages.

The Paddle Core Trainer—SUP simulator, History and Video, paddlecoretrainer.com/History_and_video.html, accessed Apr. 4, 2012, 4 pages.

Office Action issued by United States Patent and Trademark Office, Dec. 19, 2013, U.S. Appl. No. 13/620,768, 19 pages.

* cited by examiner

EXERCISE METHODS AND APPARATUS SIMULATING STAND-UP PADDLE BOARDING

CROSS-REFERENCE TO RELATED APPLICATION

The present application is a U.S. continuation-in-part patent application of, and claims priority under 35 U.S.C. §120 to, U.S. nonprovisional patent application Ser. No. 13/406,529, filed Feb. 27, 2012 now abandoned, which '529 application is incorporated herein by reference. Additionally, any publication of the '529 application and any patent issuing therefrom is hereby incorporated herein by reference.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

BACKGROUND OF THE INVENTION

The present invention generally relates to exercise methods and apparatus and, more specifically, to exercise methods and apparatus for simulating stand-up paddleboarding.

Stand-up paddle boarding is an emerging global sport. The sport benefits athletes with a strong workout of the core. Unlike surfing, stand-up paddle boarding is very easy to learn and is growing in popularity. Beginners usually can become very comfortable paddle boarding after only brief training and, unlike surfing, paddle boarding can be done without regard to the tide and condition of waves and swells. Moreover, paddleboarding can be done on rivers and lakes, and is not limited to use on the ocean. It is therefore understandable that paddle boarding is a growing recreational activity at many resorts and vacation destinations.

Paddleboarding is also a great exercise. Paddleboarding conditions not only the arm muscles, but also the back, the abdomen and the legs, which must stay engaged to keep the board from tipping. Paddleboarding also is a low impact activity, unlike running for example.

Paddleboards generally range in length between twelve and eighteen feet and resemble long surfboards. The paddle generally should extend in length to five-to-seven inches above a user's height, and the paddle generally includes a blade, shaft and handle. In particular, the paddle typically includes a flat blade on one end connecting to a handle on the other end by a long shaft. The blade ranges from six to ten inches in width with an oval or round shaft ranging from 67 to 86 inches in length with a one to one-and-a-half inch diameter. Blades can be designed with several shapes and features. Normally the blade has a pizza stone shape sometimes having a slight keel on the back side of the blade. Other commonly used shapes include diamonds, or oar like blades.

In operation, while standing on a board the user holds the paddle with one hand on the top of the handle and the other hand approximately one-third of the way down the shaft. The hand placement alternates depending on the side on which the user paddles. When paddling on the right side the handle is held with the left hand and the shaft with the right, and when paddling on the left side the handle is held with the right hand and the shaft with the left. When paddling the blade is placed in the water about one or two feet in front of the user. The paddle is then pulled through the water with a motion similar to the user punching with the top hand. The motion is continued until the blade is pulled through the water to a point approximately six inches to a foot behind the user's body, thereby performing a backstroke.

While paddleboarding provides a great workout, it is not always possible to paddleboard due to poor weather, due to being in a location at which paddleboarding in not possible (such as away from water), or both. In such situations, it is believed that a need exists for simulating paddleboarding so as to provide some of the aforementioned benefits that come from paddleboarding as an exercise.

With regard to known exercise apparatus, an exercise machine is disclosed in U.S. Patent Application Publication No. 2011/0275489 that has a pair of spaced-apart vertical columns each with hollow tubular body with a weighted plunger attached to a cable for vertical reciprocation while a user performs power and return stroke movements on an instrument attached to the other end of the cable. The plunger is hydraulically coupled to an air channel fed by an air-through valve sized to control air movement into the air channel by the rising plunger during a power stroke to approximate water resistance to an oar, paddle or arm in the water. The air channel has a release opening for releasing air balanced against the weight of the falling plunger to approximate lifting an oar, paddle, or arm out of the water on a return stroke. The exercise machine can be used to practice a wide range of water sports training exercises for swimming, paddleboarding, canoe paddling, and rowing.

While the exercise machine disclosed in this patent publication appears to be suitable for its intended purpose, and the disclosure thereof is incorporated herein by reference for background to the present invention, it is believed that improved exercise apparatus and methods nonetheless are needed for simulating paddleboarding. Accordingly, it is believed that one or more of these needs are addressed by one or more aspects of the invention.

SUMMARY OF THE INVENTION

The present invention includes many aspects and features. Moreover, while many aspects and features relate to, and are described in, the context of simulating paddleboarding, the present invention is not limited to use only in simulating paddleboarding, as will become apparent from the following summaries and detailed descriptions of aspects, features, and one or more embodiments of the present invention.

Accordingly, in an aspect of the invention, an exercise apparatus includes: a frame; a platform configured to receive a person in a standing position, the platform connected to the frame; a handheld component configured to be held by a person standing on the platform; and, an impeller-driven fluid circulation system, wherein manipulation of the handheld component by a person standing on the platform results in driving of the impeller and circulation of fluid within the fluid circulation system.

In a feature of this aspect, the platform rocks from side to side, whereby a person standing on the platform balances on the platform while manipulating the handheld component for driving of the impeller and circulation of fluid within the fluid circulation system.

In another feature, the frame is a support structure.

In another feature, the handheld component is a paddle component that includes an elongate shaft. In this respect, the paddle component preferably is used by a person standing on the platform as if the paddle component were a paddle used in paddleboarding, including manipulating the paddle component through a rowing motion that preferably would be experienced when actually paddleboarding.

In another aspect of the invention, an exercise apparatus for simulating paddleboarding includes: an elongate support structure; a platform connected to the support structure for supporting a person standing thereon; a paddle component configured to be held by a person standing on the platform and handled, by a person standing on the platform, as if it were a paddle used in paddleboarding; a housing connected to the support platform; and a tensioning line extending from the housing to the paddle component.

Additionally, the paddle component includes an elongate shaft. The tensioning line includes a first connector in proximity to a first end of the tensioning line, and the paddle component includes a second connector in proximity to a first end of the elongate shaft. The first and second connectors are configured to connect together, for connecting the paddle component to the tensioning line during the handling of the paddle component, by a person standing on the platform, as if it were a paddle used in paddleboarding; and are configured to disconnect from one another for disconnecting the paddle component from the tensioning line. The housing is spaced from the platform by a longitudinal distance sufficient to permit handling of the paddle component, by a person standing on the platform, as if it were a paddle used in paddleboarding. A second end of the tensioning line is secured within the housing, with the tensioning line extending from the housing when the first and second connectors are connected.

The housing includes a spring-biased spooling assembly configured, when the first and second connectors are connected, to wind the tensioning line thereon during the handling of the paddle component, by a person standing on the platform, as if the paddle component were a paddle used in paddleboarding, whereby tension is maintained in the tensioning line and the tensioning line is retracted into the housing when the first end of the paddle component moves toward the housing during such handling.

The housing also includes a transmission system and an impeller-driven fluid circulation system. The transmission system interconnects the spring-biased spooling assembly and an impeller of the impeller-driven fluid circulation system such that extension of the tensioning line outside of the housing during such handling results in driving of the impeller and circulation of fluid within the fluid circulation system.

In a feature, the transmission system includes a one-way clutch assembly, whereby retraction of the tensioning line into the housing does not result in driving of the impeller. The one-way clutch assembly preferably includes a one-way bearing.

In another feature, the transmission system includes a timing belt.

In another feature, the spring-biased spooling assembly comprises a constant-force spring, which preferably exerts a generally constant force in opposition to unwinding of the tensioning line during extension of the tensioning line from the housing.

In another feature, the paddle component includes a T-shaped handle at a top end of the shaft; and a handle grip along an extent of the shaft between the top end and a middle of the shaft. Furthermore, the paddle component does not include a blade; in other embodiments, the paddle component does include a blade.

In another feature, the circulation system is a closed system and the fluid is recirculated through the system.

In another feature, the platform is connected to the support structure such that the platform pivots about an axis extending generally parallel to the longitudinal spacing between the platform and the housing. Accordingly, a person standing on the platform preferably must balance his or her weight between the left and right legs when trying to keep the platform level during the handling of the paddle component as if the paddle component were a paddle used in paddleboarding. Preferably, one or more resilient members are positioned under the platform so that the platform engages the resilient members during pivoting of the platform, whereby rocking motion of the platform is dampened. Preferably, a stabilizing mechanism is also included which, when engaged, locks the platform against movement relative to the support structure. Preferably, the stabilizing mechanism is foot-operated, and a person can use the exercise device with rocking or without rocking of the standing platform, as desired.

In another feature, the exercise apparatus further comprises an auxiliary resistance system for providing additional resistance to extension of the tensioning line outside of the housing and the consequent driving of the impeller. The auxiliary resistance system preferably includes a magnetic disc driven by the transmission system through a magnetic field. Furthermore, an extent of the magnetic field through which the magnetic disc is driven by the transmission system preferably is adjustable such that the resistance provided by the auxiliary resistance system is adjustable. A control may be used wherein adjustment of the control results in adjustment of the resistance provided by the auxiliary resistance system. In this respect, the control and the first end of the shaft of the paddle component preferably are configured to engage one another for adjustment of the control by a person standing on the platform. Such adjustment may be accomplished by inserting this end of the shaft into a recess of the control and rotating the shaft about an axis of the shaft.

In another feature, the fluid circulation system includes a fluid. The fluid may be water or a water-based solution. Preferably, the fluid circulation system has a capacity of about three fluid gallons.

In another aspect of the invention, a method of exercising that simulates paddleboarding includes the steps of: standing on a platform; and while standing on the platform, handling a paddle component of an exercise machine as if the paddle component were a paddle used in paddleboarding by manipulating the paddle component through a rowing motion including a backstroke. A resistance is encountered during the backstroke of the rowing motion that is similar to a resistance encountered when a paddle is used in paddleboarding to propel a paddleboard.

With further accordance with this aspect, the backstroke of the rowing motion results in the drawing out of a tensioning line of the exercise machine which, in turn, causes an impeller of the exercise machine to be driven such that a fluid is circulated through a closed system of the exercise machine. Additionally, tension is maintained in the tensioning line during the rowing motion by spring-biasing a spooling assembly of the exercise machine to wind-up the tensioning line. The backstroke acts in opposition to the spring-biasing of the spooling assembly, and the tensioning line is wound-up as the paddle component moves toward the housing during the rowing motion.

In a feature, the platform pivots or rocks side to side. Furthermore, the method includes the step of balancing by a person on the platform while manipulating the paddle component through the rowing motion.

In yet another aspect, a method of providing an exercise experience simulating paddleboarding includes the steps of: spring-biasing a spooling assembly of an exercise machine to wind-up a tensioning line; and causing an impeller of the exercise machine to be driven such that a fluid is circulated through a closed system of the exercise machine when the tensioning line is drawn out during the backstroke of the rowing motion. The spring-biasing of the spooling assembly acts in opposition to a force drawing out the tensioning line that results from a backstroke of a rowing motion of a paddle component.

In a feature, the spring-biasing of the spooling assembly is performed using a constant-force spring.

In another feature, the method further includes providing resistance to the drawing out of the tensioning line by causing a magnetic disc to spin within a magnetic field as the tensioning line is unwound. In this respect, the method further includes adjusting the resistance that is provided to the drawing out of the tensioning line by changing the magnetic field through which the magnetic disk spins as the tensioning line is unwound.

In addition to the aforementioned aspects and features of the present invention, it should be noted that the present invention further encompasses the various possible combinations and subcombinations of such aspects and features. Thus, for example, any aspect may be combined with an aforementioned feature in accordance with the present invention without requiring any other aspect or feature.

BRIEF DESCRIPTION OF THE DRAWINGS

One or more preferred embodiments of the present invention now will be described in detail with reference to the accompanying drawings.

FIGS. 1*a*-12*a* represent grayscale drawings corresponding to the black and white drawings of FIGS. 1-12, and are provided for additional clarity and perspective.

DETAILED DESCRIPTION

Figure 2:
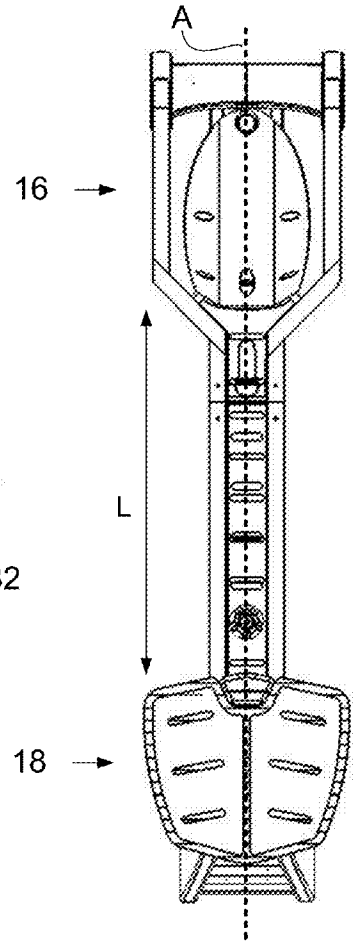
FIG. 2 is a top plan view of part of the exercise apparatus of FIG. 1.

As a preliminary matter, it will readily be understood by one having ordinary skill in the relevant art ("Ordinary Artisan") that the present invention has broad utility and application. As should be understood, any embodiment may incorporate only one or a plurality of the above-disclosed aspects of the invention and may further incorporate only one or a plurality of the above-disclosed features. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention, which scope is to be defined by the claims and the equivalents thereof. It is not intended that the scope of patent protection afforded the present invention be defined by reading into any claim a limitation found herein that does not explicitly appear in the claim it self.

Thus, for example, any sequence(s) and/or temporal order of steps of various processes or methods that are described herein are illustrative and not restrictive.

Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention. Accordingly, it is intended that the scope of patent protection afforded the present invention is to be defined by the appended claims rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. §112, ¶6 with respect to the United States, no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the drawings, one or more preferred embodiments of the present invention are next described. The following description of one or more preferred embodiments is merely exemplary in nature and is in no way intended to limit the invention, its implementations, or uses.

Figure 1:
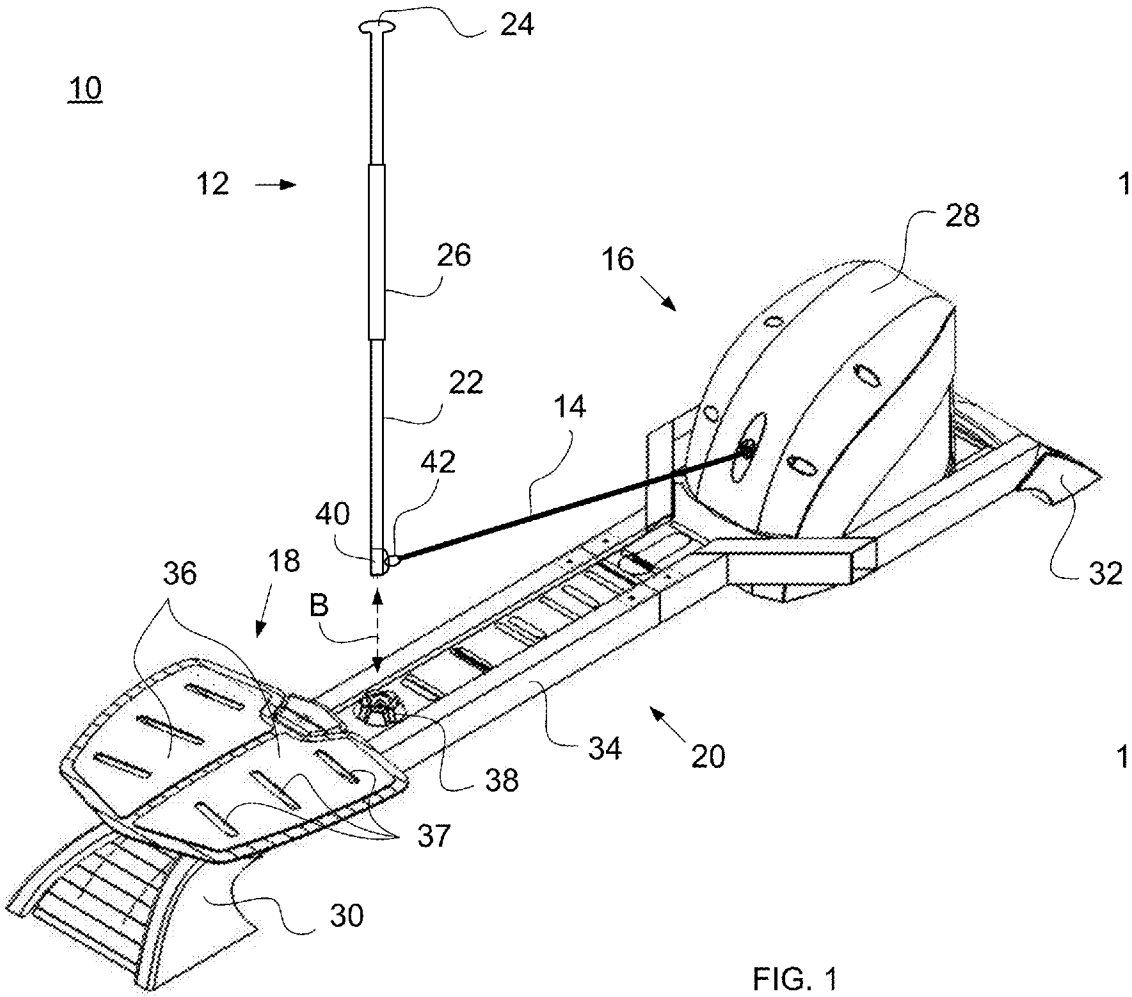
FIG. 1 is a perspective view of an exercise apparatus in accordance with a preferred embodiment of the invention.
Figure 2A:
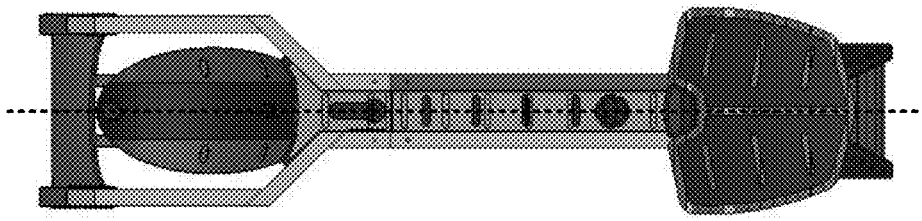
Figure 1A:
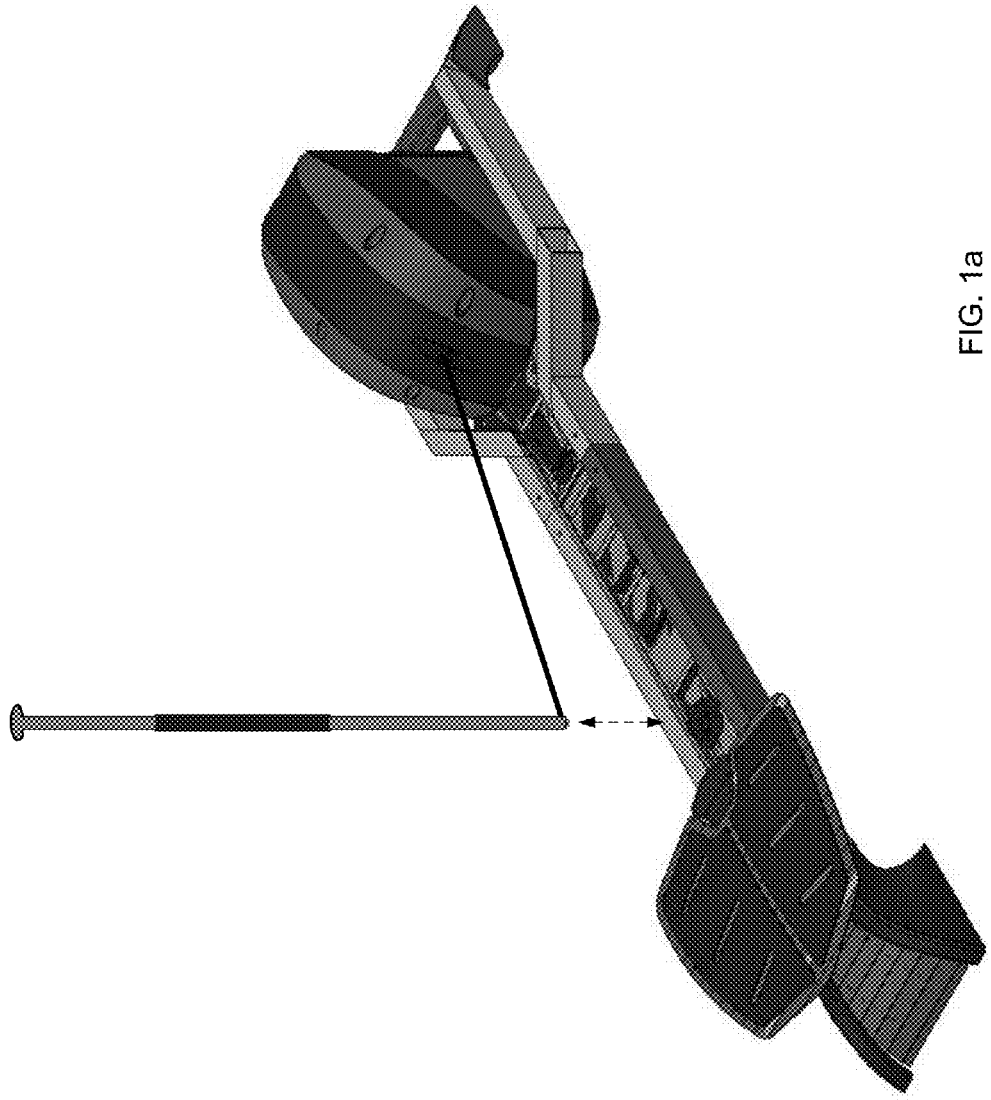

FIG. 1 is a perspective view of an exercise apparatus 10 in accordance with a preferred embodiment of the invention. The exercise apparatus 10 includes a paddle component 12, a tensioning line 14, and a housing 16. The exercise device 10 also includes a platform 18 for standing upon by a person when exercising, and an elongate support structure 20 to which the housing 16 and platform 18 are connected.

The paddle component includes a shaft 22, T-shaped handle 24 at a top end of the shaft 22, and a pad forming a grip 26 extending along an extent of the shaft 22 between the top end and a middle of the shaft 22.

The housing 16 includes a cover 28 from which the tensioning line 14 is shown extending in FIG. 1. One end of the tensioning line 14 is secured within the housing 16, and another end of the tensioning line 14 is secured to the end of the shaft 22 opposite the handle 24, as shown in FIG. 1.

The platform 18 includes a top surface that generally comprises two mirrored sections 36, each of which is configured to receive a foot or shoe of a person standing on the platform 18. Each section 36 includes protuberances 37, shown in FIG. 1 as raised ribs, for providing foot traction.

The platform 18 preferably is connected to the support structure 20 such that the platform 18 pivots about a platform tilt axis extending generally parallel to the longitudinal spacing L (see FIG. 2) between the platform 18 and the housing 16. Accordingly, a person standing on the platform 18 in the exercise apparatus 10 preferably must balance his or her weight between the left and right legs when trying to keep the platform 18 level during the handling of the paddle component 12, as if the paddle component 12 were a paddle used in paddleboarding.

It is believed that it would be desirable to also provide for a stable platform that is fixed against movement about the platform tilt axis, at least in some preferred embodiments. To this end, a mechanism also preferably is included by which the platform 18 may be locked or fixed against pivoting moment. The mechanism preferably comprises a latch.

A cutaway of a platform and a platform latch mechanism 2348 of an exercise device 2300 are shown in FIGS. 23*a* and 26*a*-27*a*, wherein it can be seen that the platform pivots about a central shaft 2346 when the latch of the platform latch mechanism 2348 is unlocked. Moreover, the latch mechanism 2348 preferably includes—and is operable at least for locking the platform via a person's foot with—a foot pedal 2350 is located at the forward edge of the platform. When unlocked, the platform can be tilted from side to side to replicate the feel of an actual paddleboard in water.

The platform latch mechanism 2348 that stabilizes the platform as shown in FIGS. 23*a* and 26*a*-27*a* preferably is included in the exercise apparatus 10 by which the platform 18 is selectively locked against pivoting, side to side movement about the platform tilt axis. When engaged, the mechanism preferably locks the platform 18 against movement relative to the support structure. Accordingly, a person can use the exercise device 10 with rocking or without rocking of the platform 18, as desired.

Figure 28A:
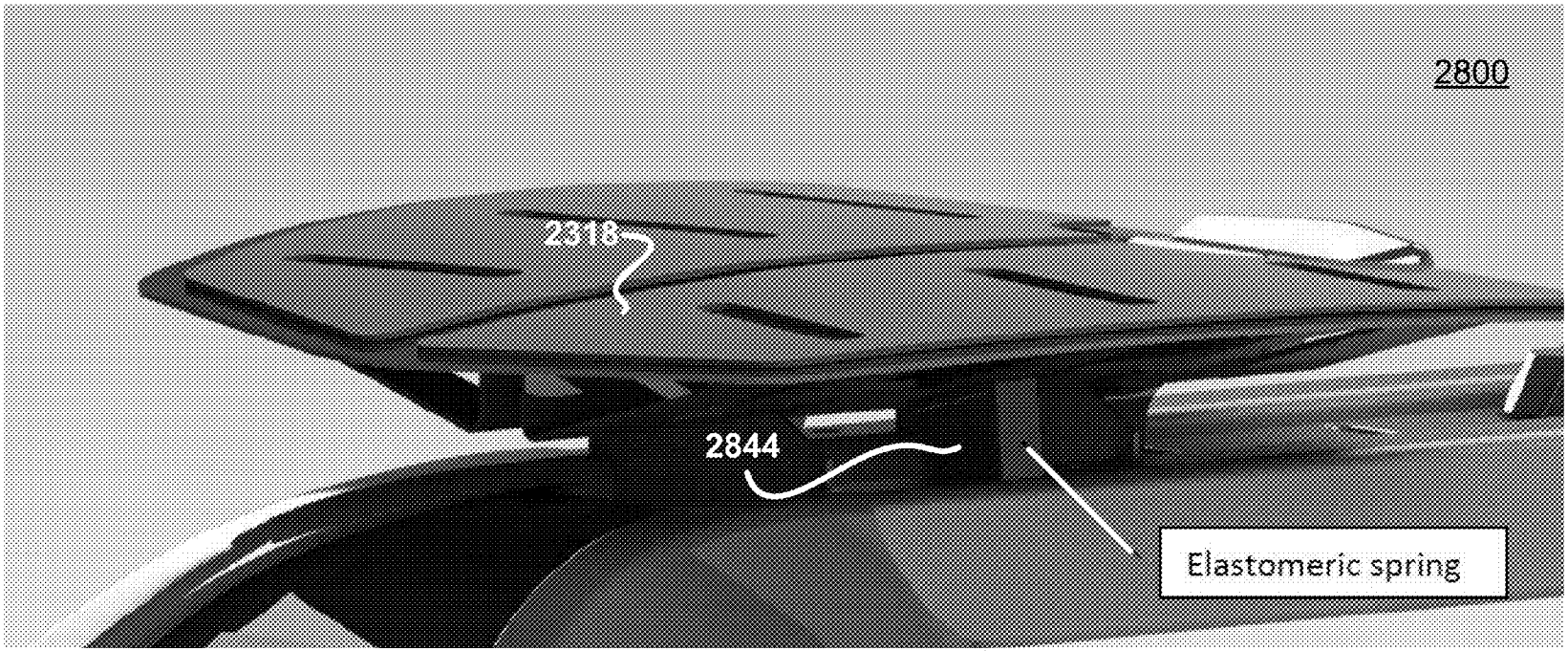
FIG. 28*a* is a perspective view of a portion of another exercise apparatus in accordance with a preferred embodiment of the invention.
Figure 29A:
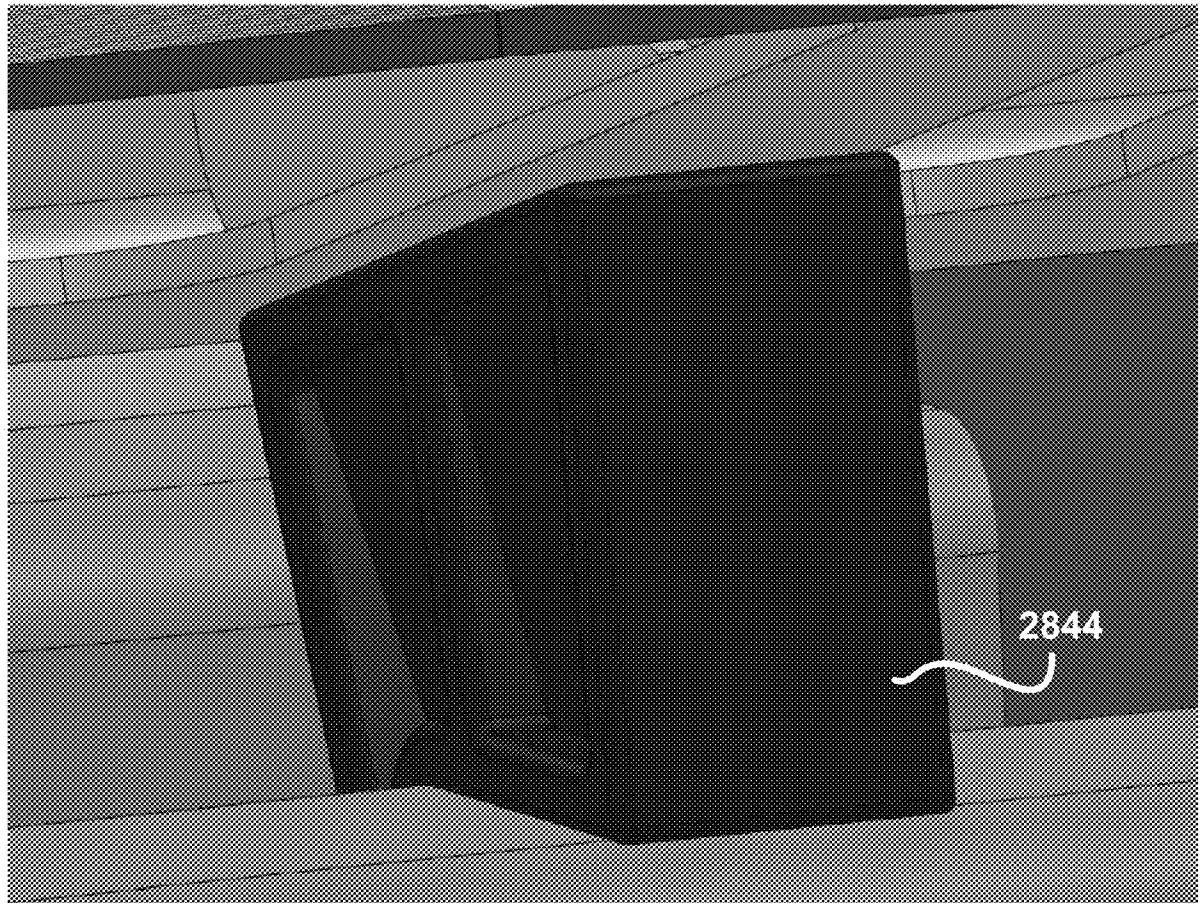
FIG. 29*a* is a perspective view of a portion of the exercise apparatus of FIG. 28*a*.

With brief reference now to FIGS. 28*a* and 29*a*, which show exercise apparatus 2800 in accordance with another preferred embodiment, one or more resilient members in the form of elastomeric spring blocks 2844 are positioned under the platform in at least some preferred embodiments so that the platform engages the elastomeric spring blocks 2844 during pivoting of the platform, whereby rocking motion of the platform is dampened. These elastomeric spring blocks 2844 support, provide resistance to rotation, and self-center the platform.

In particular, the blocks 2844 are positioned between the lower structure of the standing platform and the frame rails of the support structure. The geometry of elastomeric spring blocks provides a variable spring-rate, which allows people of different body weight to experience close to the same range of motion and propensity for the platform to move. This is beneficial, as a secondary goal of the stand-up paddleboard exercise apparatus is the act of balancing and the use of many different muscle groups to achieve that balance. Durometer of the elastomeric spring blocks preferably is 60 shore a, but different spring designs with different a combination of different durometer materials could be used.

Returning now to FIG. 1, two elastomeric spring blocks, such as those shown in FIGS. 28*a* and 29*a*, preferably are located under the platform 18 in the exercise apparatus 10, with a respective one disposed under each section 37 of the platform 18.

With continuing reference again to FIG. 1, this drawing further shows a control 38 that may be used by a person standing on the platform 18 for adjustment of a resistance that is experienced when using the exercise apparatus 10. The mechanisms that provide the resistance are described in detail below. The adjustment is accomplished, however, as indicated in FIG. 1, wherein the paddle component 12 is shown having a bottom end that is receivable within the control 38. In particular, the bottom end of the shaft 22 of the paddle component 12 is shaped and dimensioned to be received in abutting engagement with a correspondingly shaped and dimensioned recess that is defined in the top of the control 38, as indicated by the dashed line B in FIG. 1. When the first end of the shaft of the paddle component is inserted into the recess, the shaft may be rotated about its axis resulting in rotation of the control 38.

As shown in FIG. 2, which is a top plan view of part of the exercise apparatus 10 wherein the paddle component 12 and tensioning line 14 have been omitted for illustration purposes, the housing 16 and platform 18 are spaced apart along an axis A by a longitudinal distance L. In particular, elevated rails 34 extend therebetween. The axis A also extends between and equally divides the two mirrored sections 36 as shown in FIG. 2.

The tensioning line 14 preferably includes a first connector 42 located in proximity to the end of the tensioning line exterior of the housing 16, and the paddle component 12 preferably includes a second connector 40 in proximity to the bottom end of the shaft 22. The first and second connectors 40,42 are configured to connect together, for connecting the paddle component 12 to the tensioning line 14 during the handling of the paddle component 12, by a person standing on the platform 18, as if the paddle component 12 were a paddle used in paddleboarding; and are configured to disconnect from each another for disconnecting the paddle component 12 from the tensioning line 14. The spacing L of the housing 16 from the platform 18 is sufficient to permit such handling of the paddle component 12 by a person standing on the platform 18 as if the paddle component 12 were a paddle used in paddleboarding.

Figure 3:
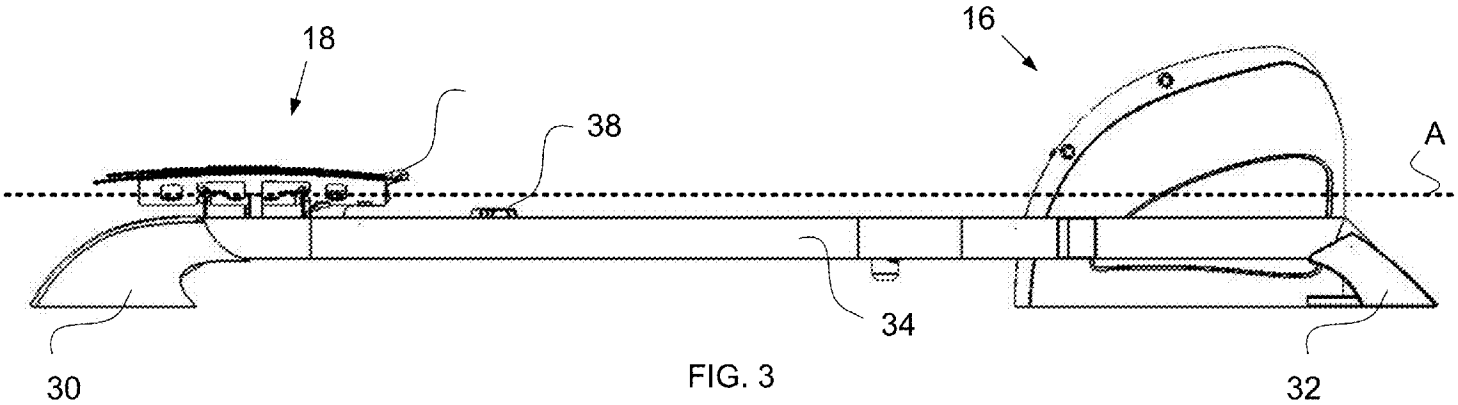
FIG. 3 is a plan view of a first side of the part of the exercise apparatus of FIG. 2.
Figure 4:
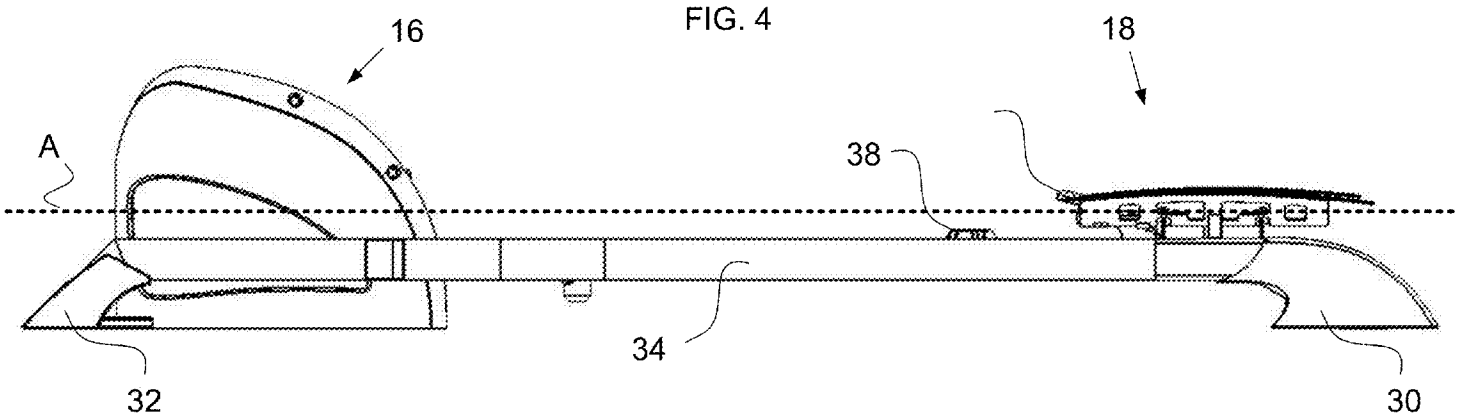
FIG. 4 is a plan view of an opposite side of the part of the exercise apparatus.
Figure 3A:
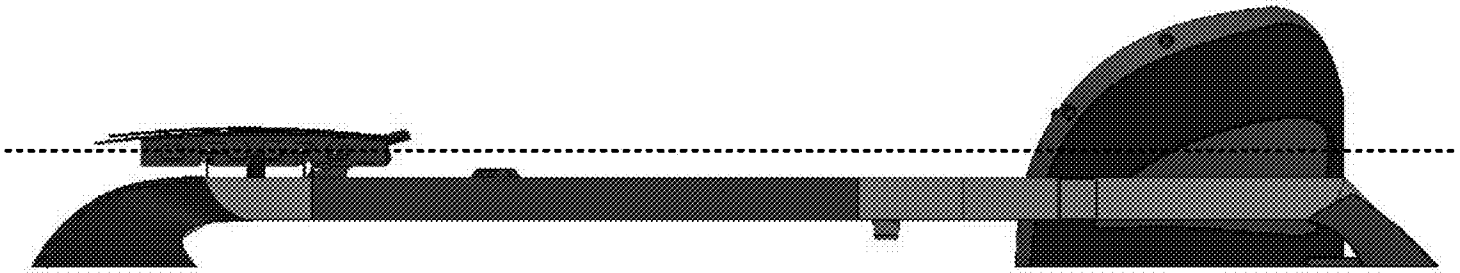
Figure 4A:
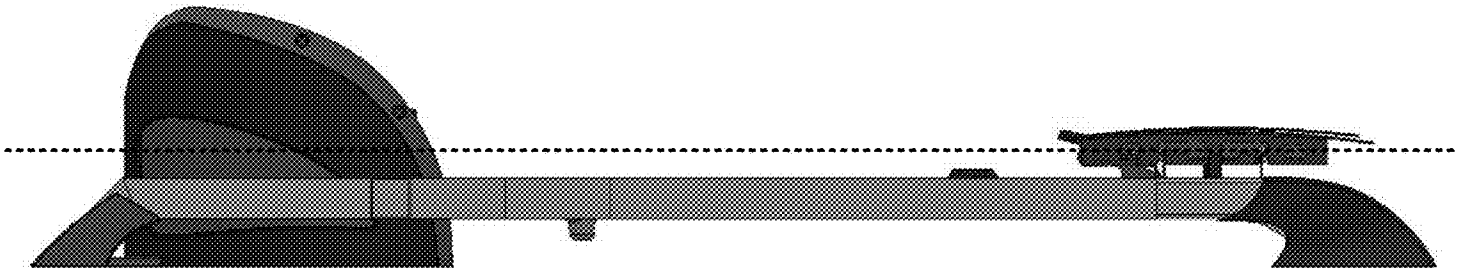

The exercise apparatus 10 is intended to be used indoors, whether at a home, gym, office, or other location. The elongate support structure 20 supports the platform 18 at an elevation to the floor such that a person steps up and onto the platform 18 for exercising. The elongate support structure 20 includes respective feet 30,32 at opposite ends thereof, as perhaps best shown in FIGS. 3 and 4, which are plan views of opposite lateral sides of the exercise apparatus 10 wherein the paddle component 12 and tensioning line 14 have been omitted for illustration purposes.

The housing 16 preferably contains, as shown in the drawings, a spring-biased spooling assembly configured, when the first and second connectors are connected, to wind the tensioning line thereon during the handling of the paddle component, by a person standing on the platform, as if the paddle component were a paddle used in paddleboarding. The spring-biased spooling assembly maintains tension in the tensioning line and the tensioning line is retracted into the housing when the first end of the paddle component moves toward the housing during such handling. The spring-biased spooling assembly preferably includes a constant-force spring, which preferably exerts a generally constant force in opposition to unwinding of the tensioning line during extension of the tensioning line from the housing.

The housing also contains a transmission system and an impeller-driven fluid circulation system. The transmission system interconnects the spring-biased spooling assembly and an impeller of the impeller-driven fluid circulation system such that extension of the tensioning line outside of the housing during such handling results in driving of the impeller and circulation of fluid within the fluid circulation system. The transmission system preferably includes a one-way clutch assembly, whereby retraction of the tensioning line into the housing does not result in driving of the impeller. The one-way clutch assembly preferably includes a one-way bearing. The transmission system also preferably includes a timing belt.

It is currently contemplated that the input torque be transmitted from the cord spool through a 1:2.5 timing belt based drive transmission, but other ratios could be utilized. Output from the timing belt transmission drives the impeller shaft. Force level experienced by the user is primarily determined by the RPM of the impeller shaft, which is determined by the timing belt transmission ratio. The one-way bearing in one of the pulleys ensures that minimal resistance is felt by the user when the cord is being drawn back into the mechanism. Without this one-way bearing, the drive system would need to reverse on each stroke, and the constant force spring needed to retract the cord would need to be of a higher force. Thus, resistance is removed from the forward component of the exercise stroke, replicating the motion of actual stand-up paddling. This water and impeller based mechanism is the primary resistance system.

The housing also contains an auxiliary resistance system for providing additional resistance to extension of the tensioning line outside of the housing and the consequent driving of the impeller. The auxiliary resistance system preferably includes a magnetic disc driven by the transmission system through a magnetic field. Furthermore, an extent of the magnetic field through which the magnetic disc is driven by the transmission system preferably is adjustable such that the resistance provided by the auxiliary resistance system is adjustable.

Specifically, in the referenced preferred embodiment shown, on the pulley that is attached to the impeller shaft, there is an aluminum conductor disc. This disc utilizes magnetically induced eddy currents to provide additional resistance. Magnets are positioned on either side of the conductor disc. Eddy currents are induced as the disc spins through the magnetic field created by the magnet array. These currents create an inductive magnetic field of their own, which opposes the field created by the magnet array. By changing the position of the magnet array, the eddy currents, and the opposing force component created by the inductive field they create can be adjusted.

As perhaps best illustrated in FIGS. 24*a*-25*a* with reference to exercise apparatus 2300, the circulation system is contained within a pump housing 2346 and is a closed. The fluid is recirculated through the system by driving of the impeller 2375.

Figure 5:
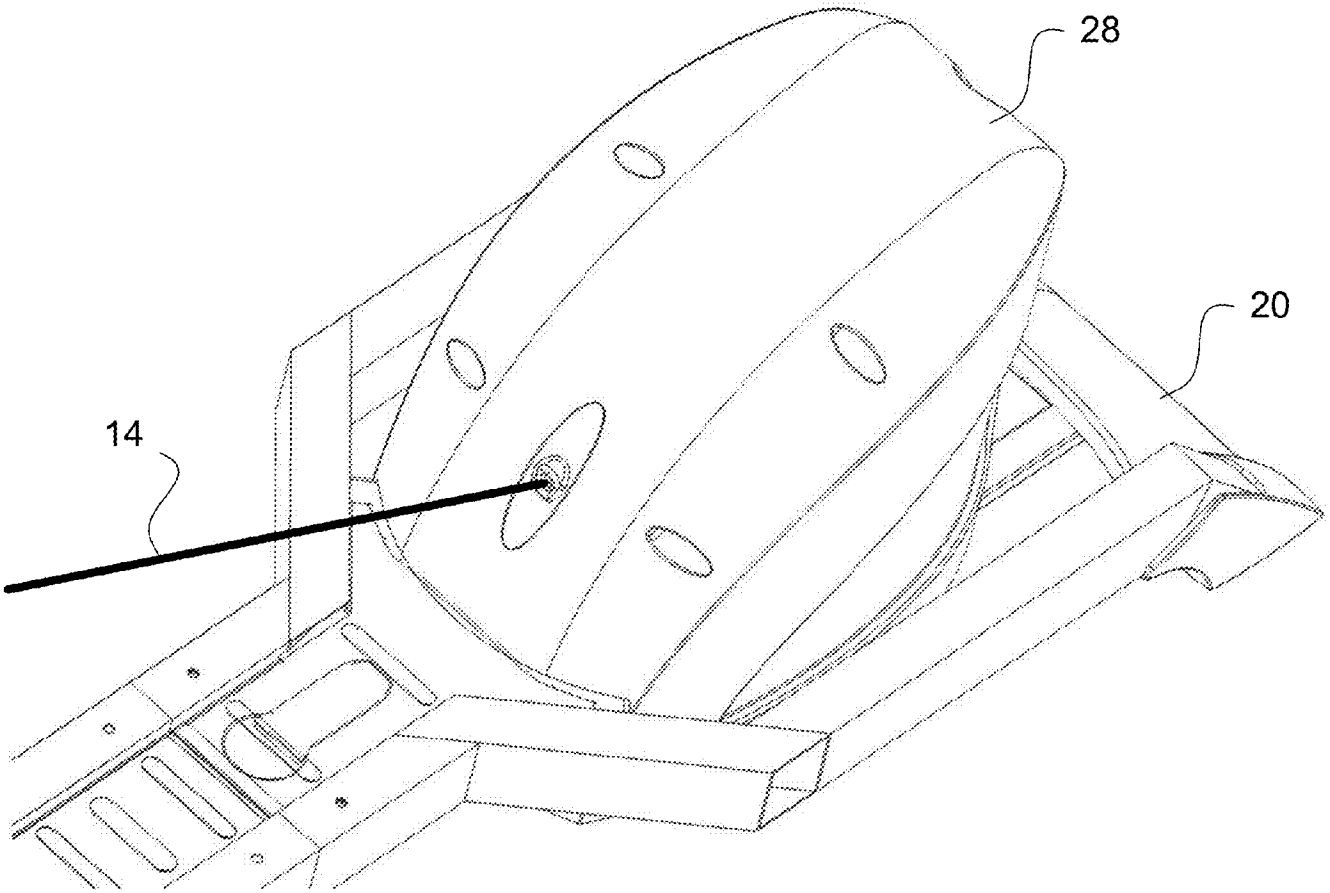
FIG. 5 is a perspective, partial view of an end of the exercise apparatus of FIG. 1.
Figure 5A:
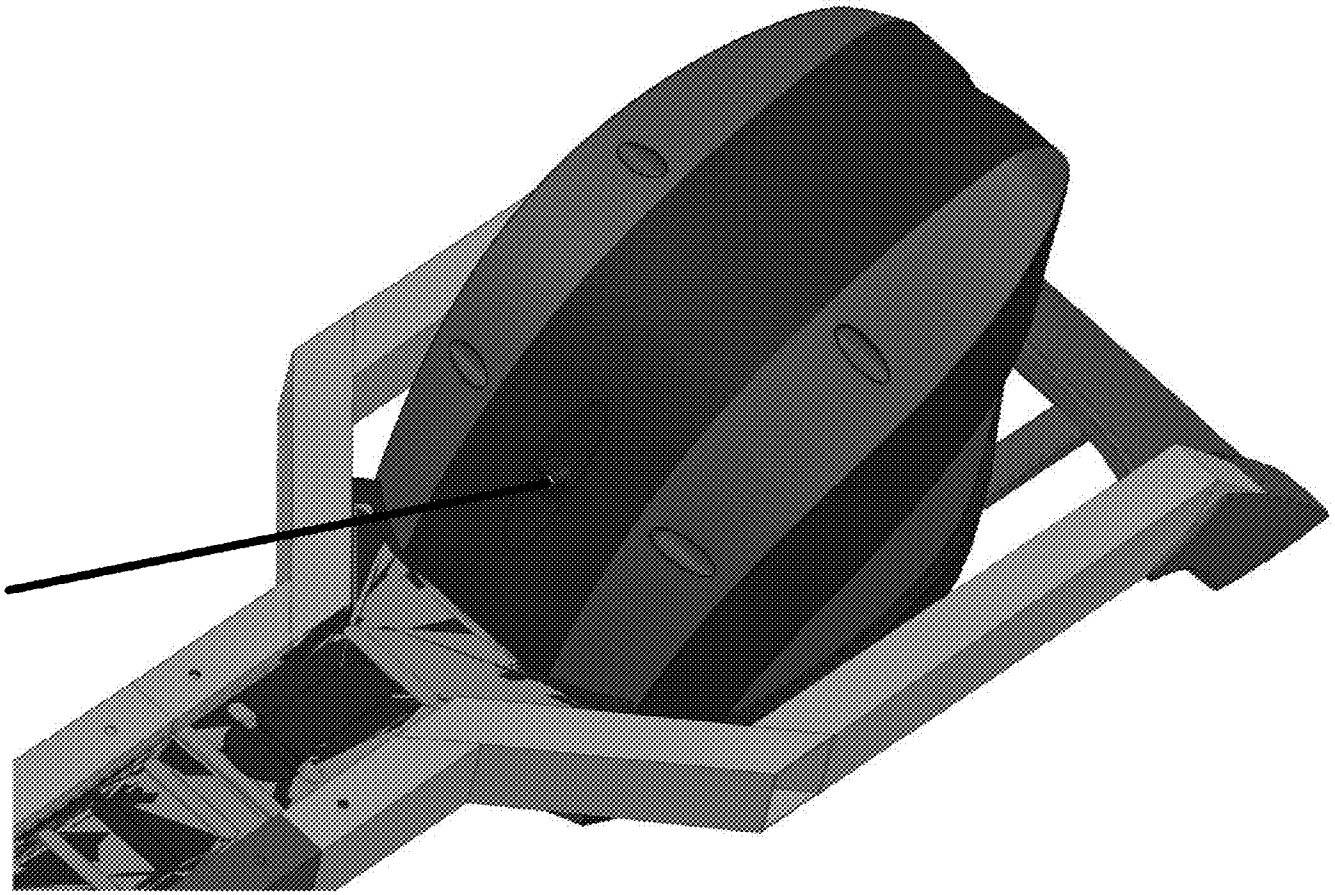

FIG. 5 is a perspective, partial view of an end of the exercise apparatus 10 of FIG. 1, which end includes the housing shown with cover 28.

Figure 6:
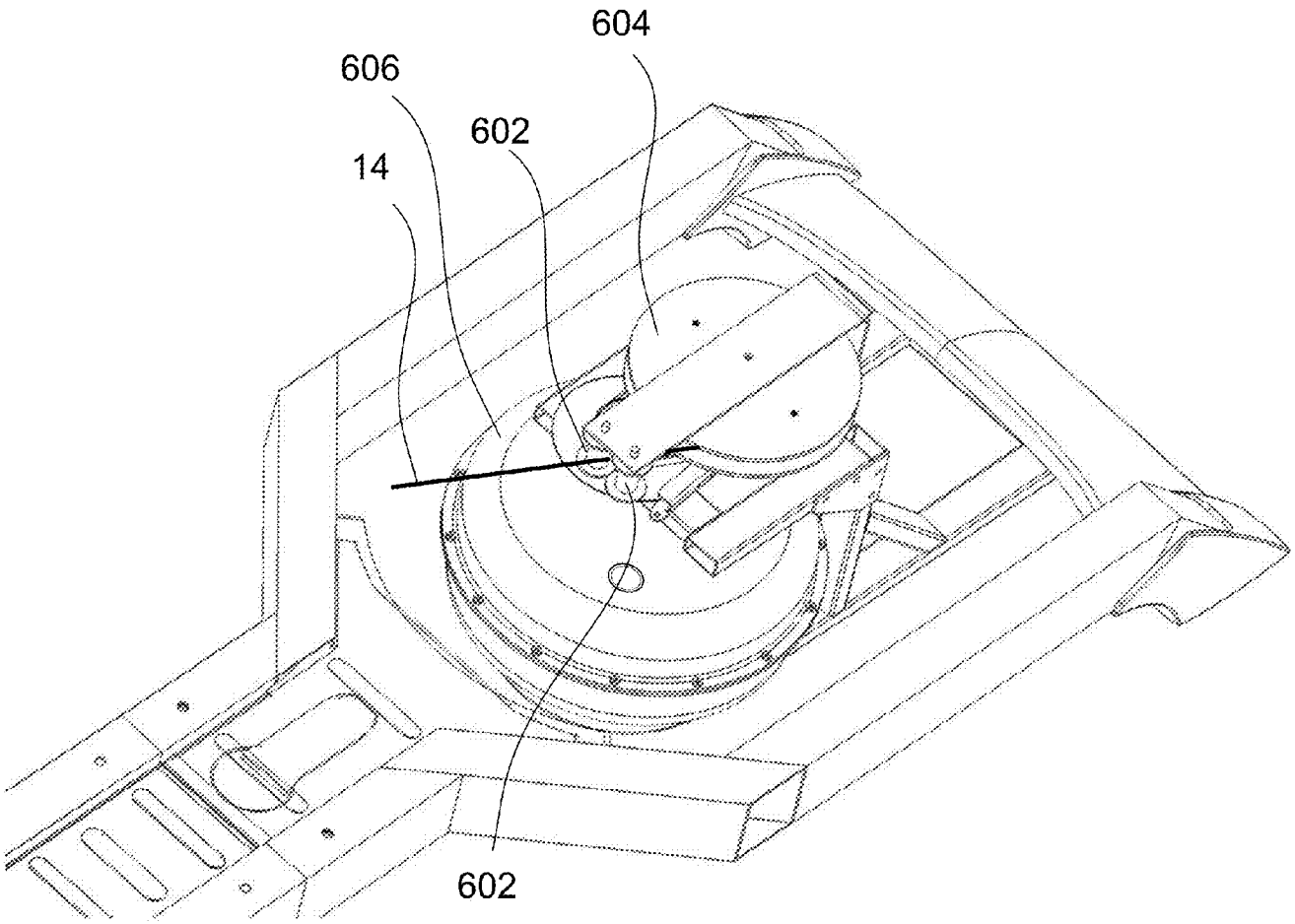
FIG. 6 comprises the view of FIG. 5 in which the housing and other components have been omitted.
Figure 6A:
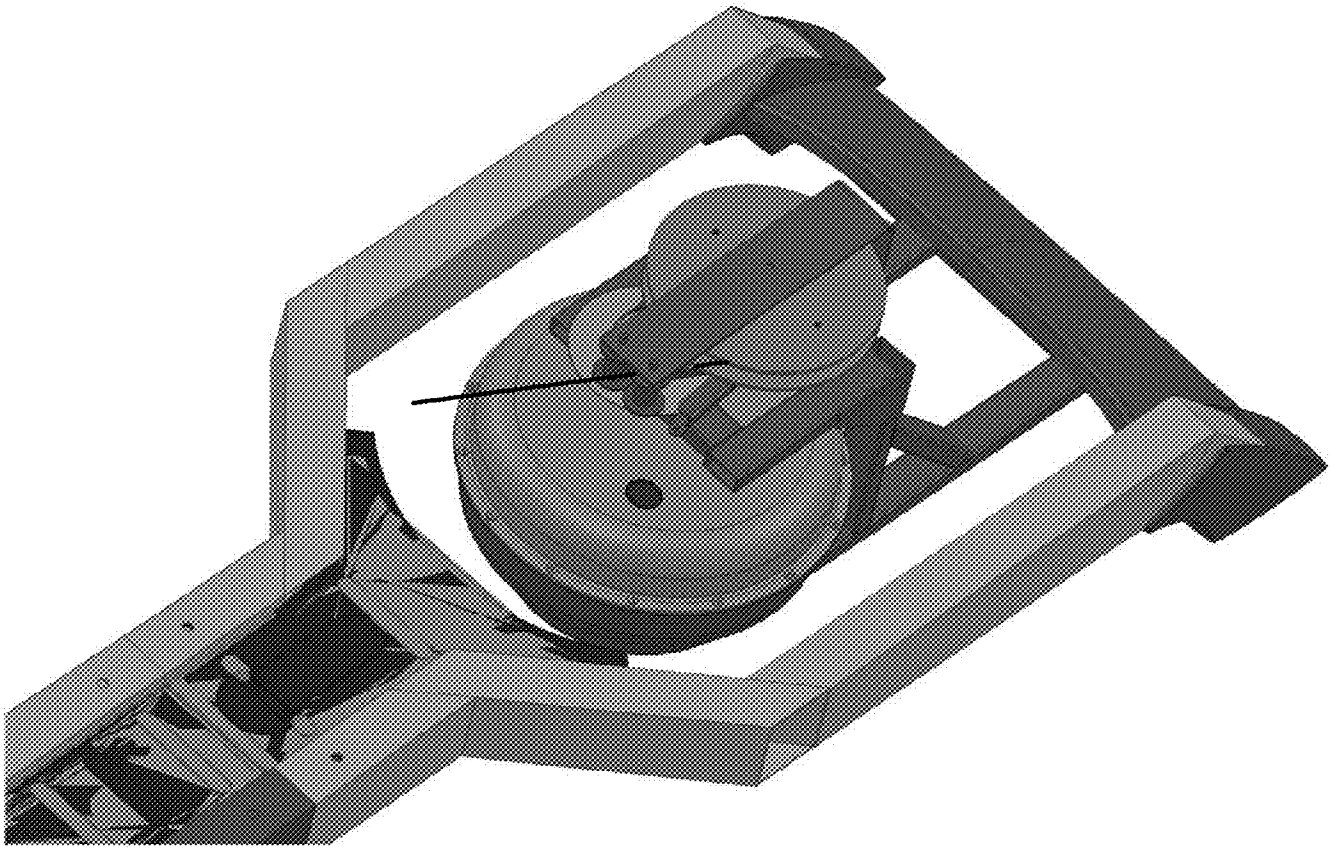

FIG. 6 comprises the view of FIG. 5 in which the housing and other components have been omitted for clarity, whereby additional components of the exercise apparatus 10 are revealed. These additional components include guide rollers 602 for guiding of the tensioning line 14 toward the spooling assembly 604; and a pump housing 606 of the circulation system.

Figure 7:
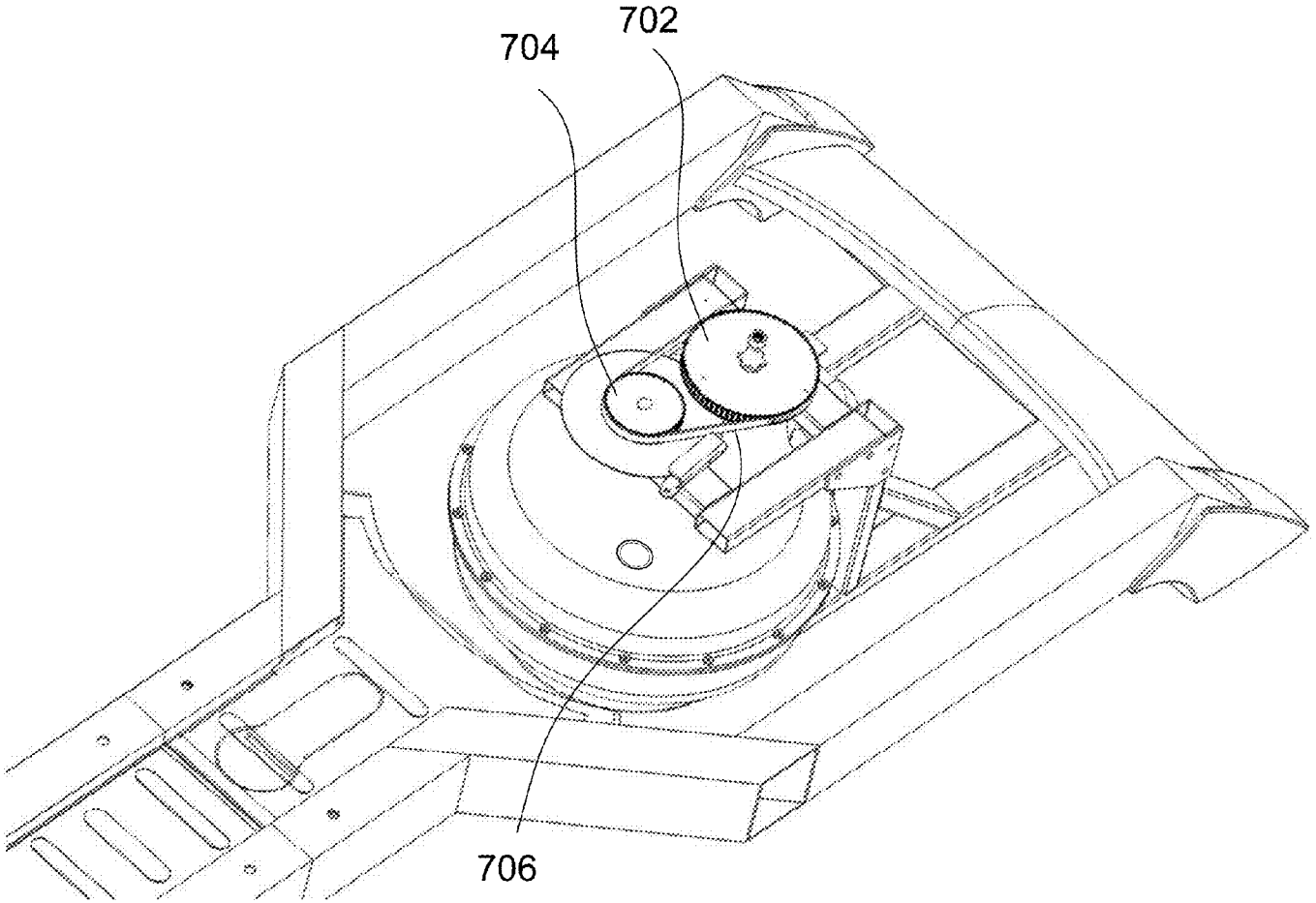
FIG. 7 comprises the view of FIG. 6 with additional components omitted.
Figure 7A:
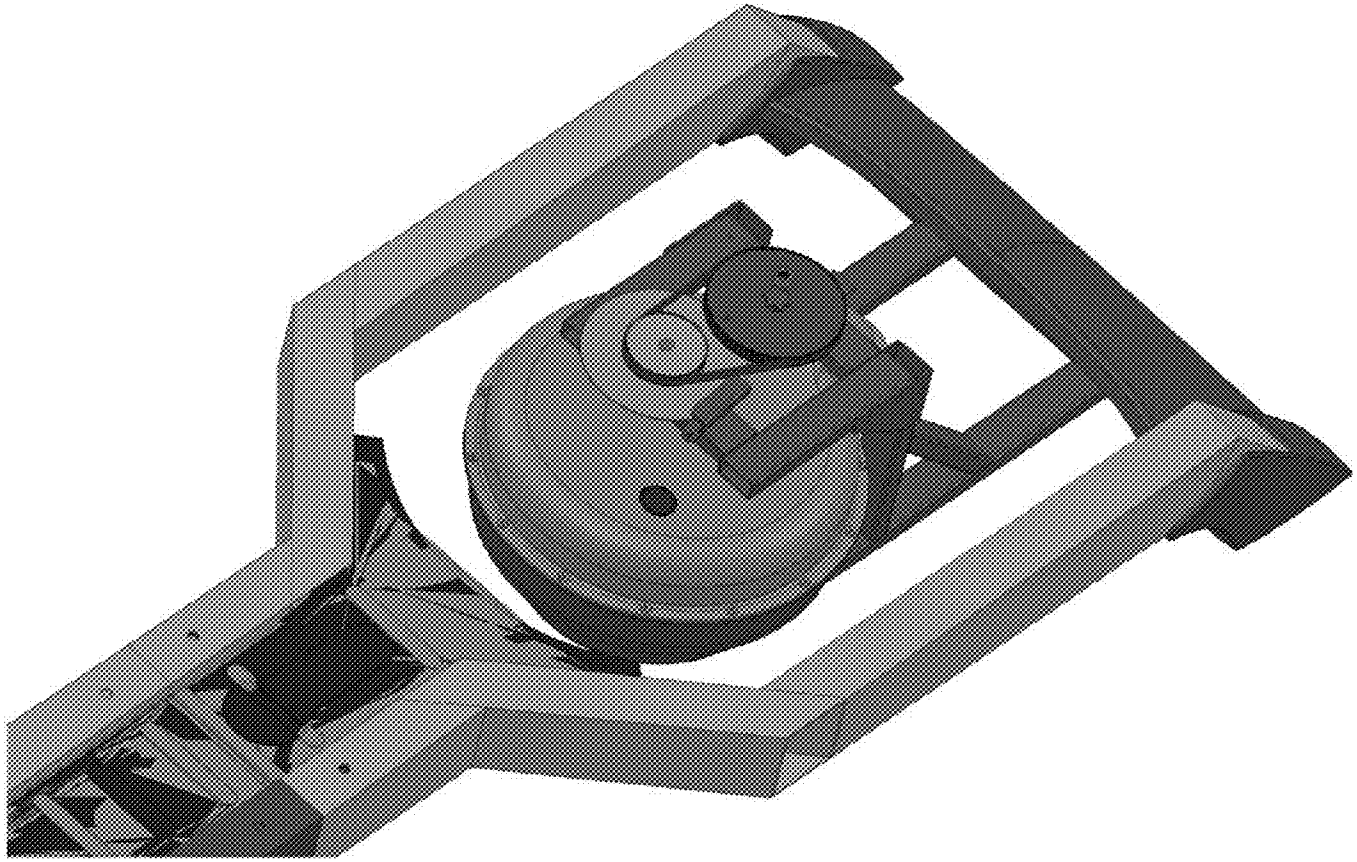

FIG. 7 comprises the view of FIG. 6 in which additional components have been omitted for clarity, whereby additional components of the exercise apparatus 10 are revealed. These additional components include two pulleys 702,704 and a drive-belt 706 of the transmission system.

Figure 8:
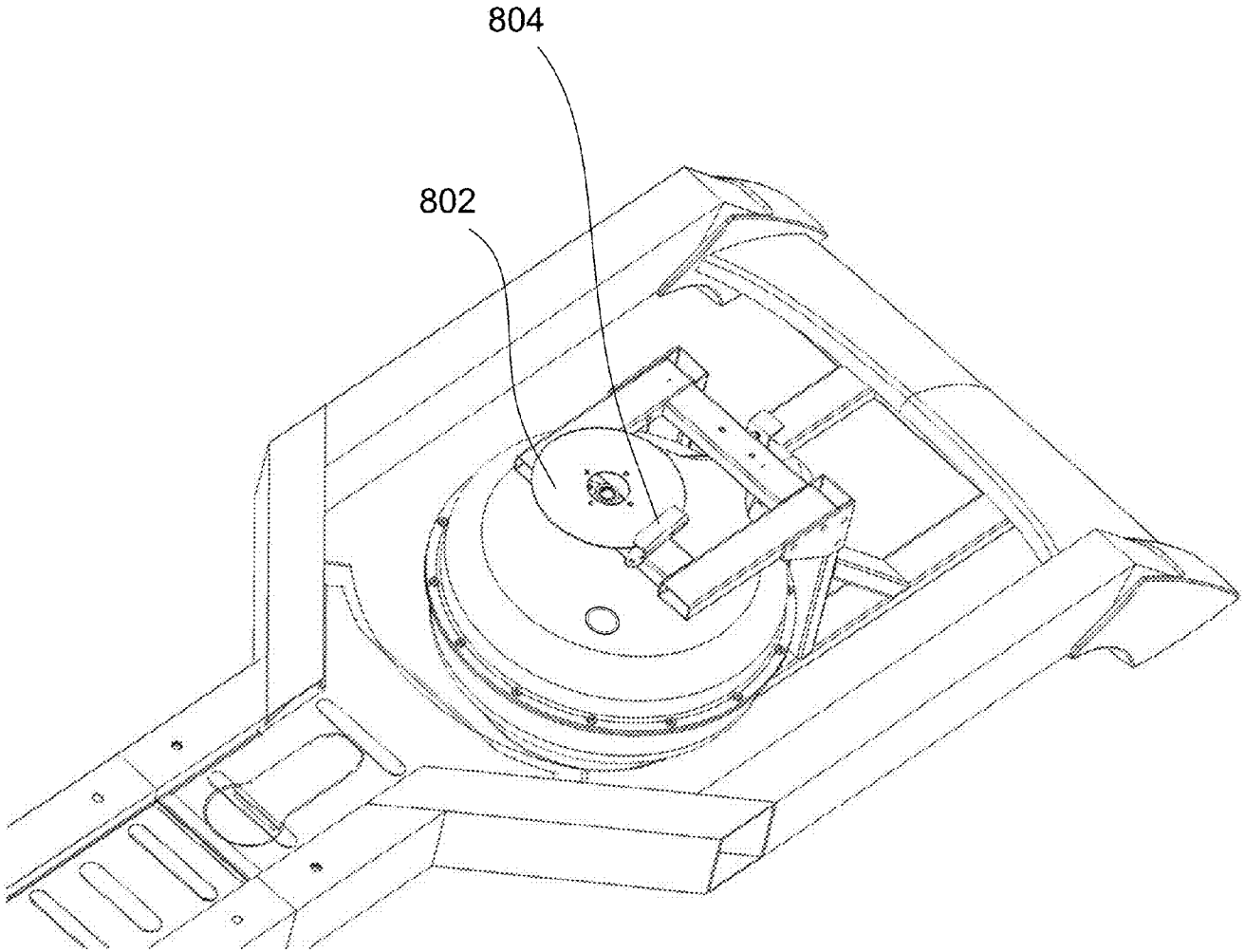
FIG. 8 comprises the view of FIG. 7 with additional components omitted.
Figure 8A:
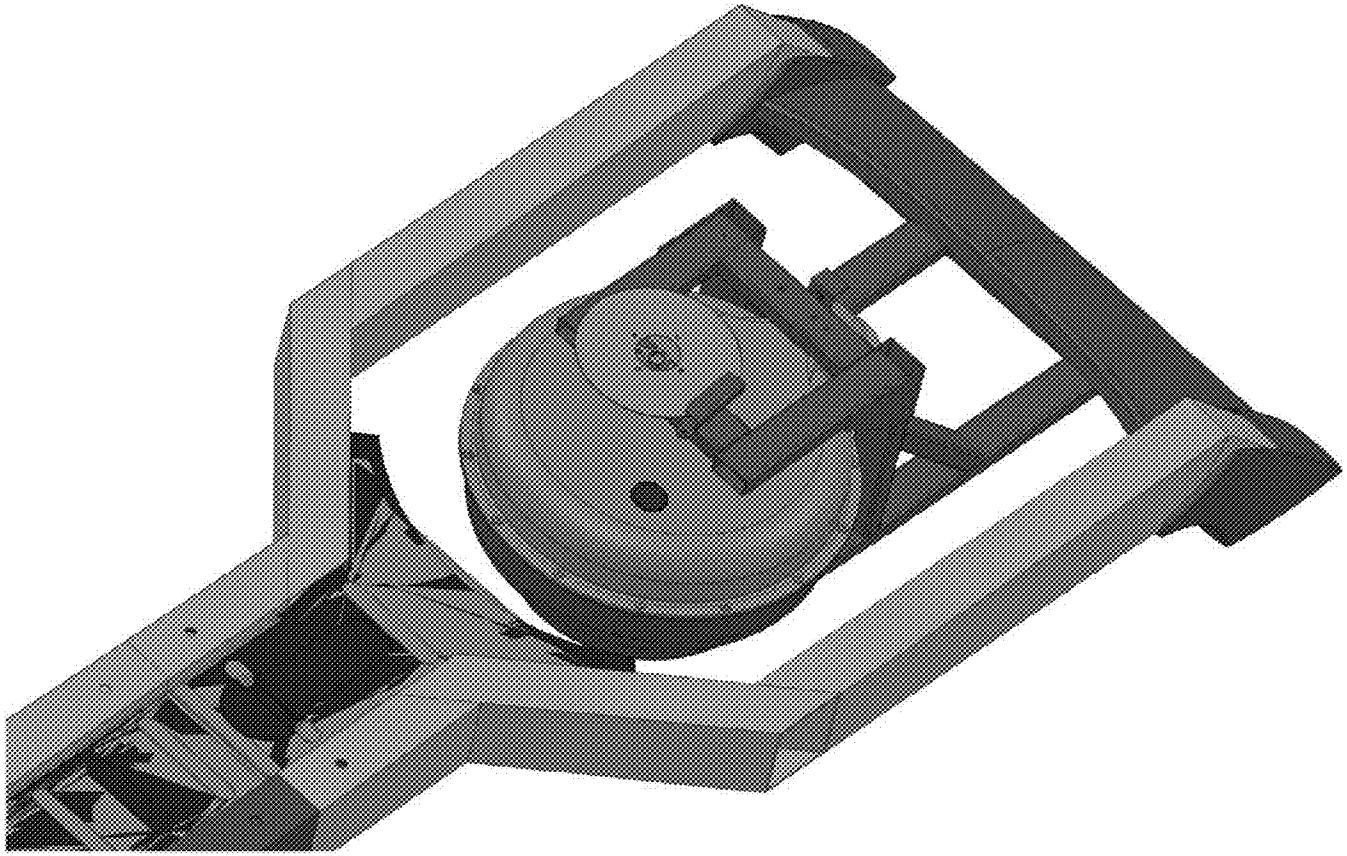

FIG. 8 comprises the view of FIG. 7 in which additional components have been omitted for clarity, whereby additional components of the exercise apparatus 10 are revealed. These additional components include an aluminum conductor disc 802 and magnet array 804 of the auxiliary resistance system.

Figure 9:
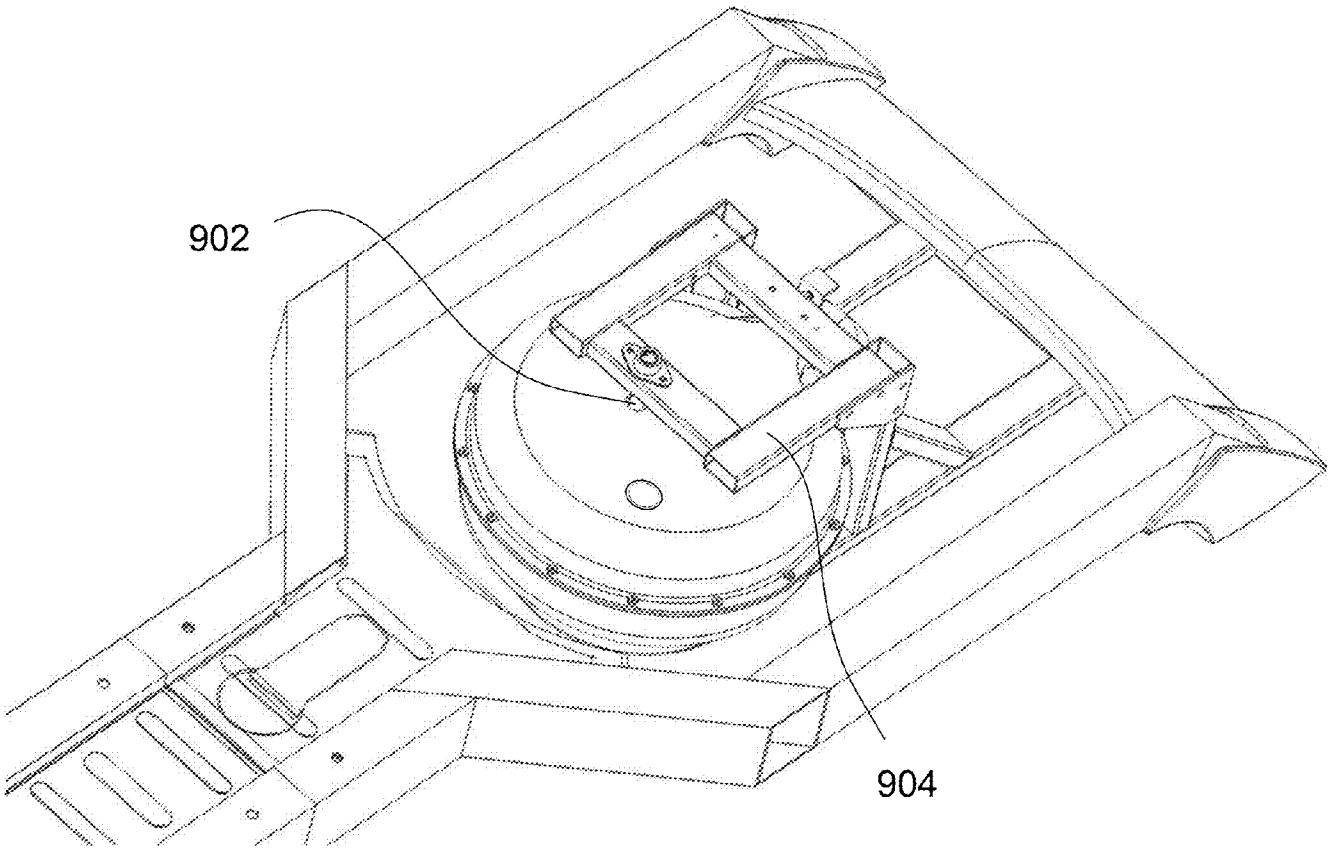
FIG. 9 comprises the view of FIG. 8 with additional components omitted.
Figure 9A:
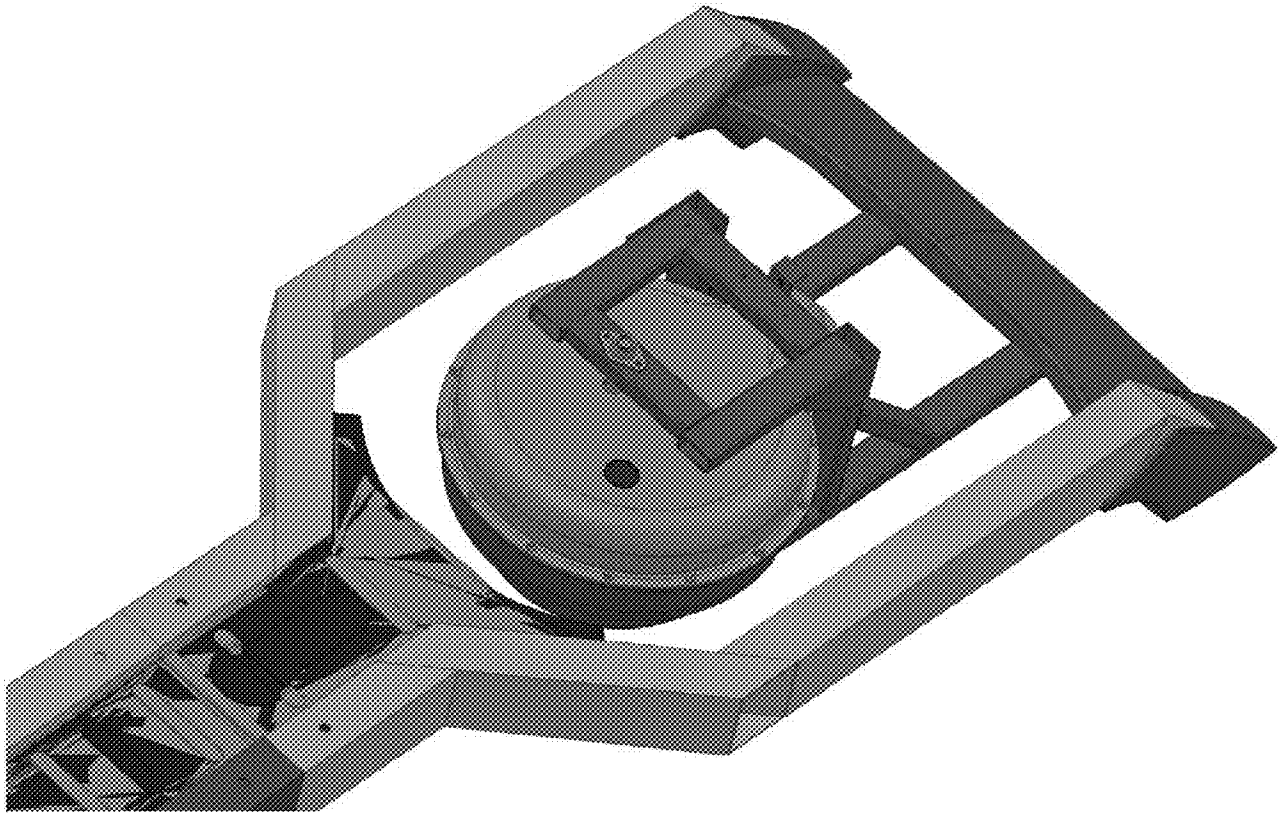

FIG. 9 comprises the view of FIG. 8 in which additional components have been omitted for clarity, whereby additional components of the exercise apparatus 10 are revealed. These additional components include the drive shaft 902 by which an impeller located within the pump housing is driven; and a support framework 904 for the previous components shown, including the transmission system and auxiliary resistance system.

Figure 10:
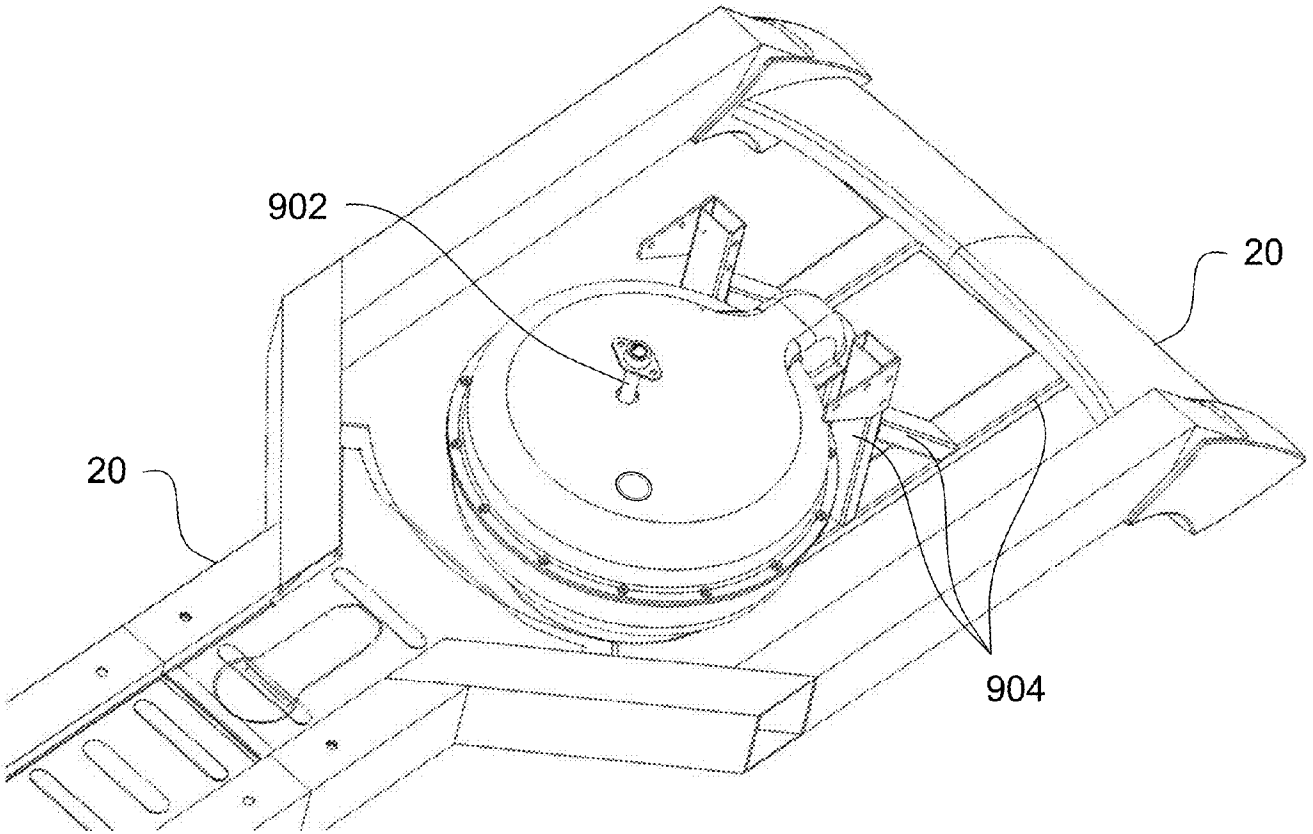
FIG. 10 comprises the view of FIG. 9 with additional components omitted.
Figure 10A:
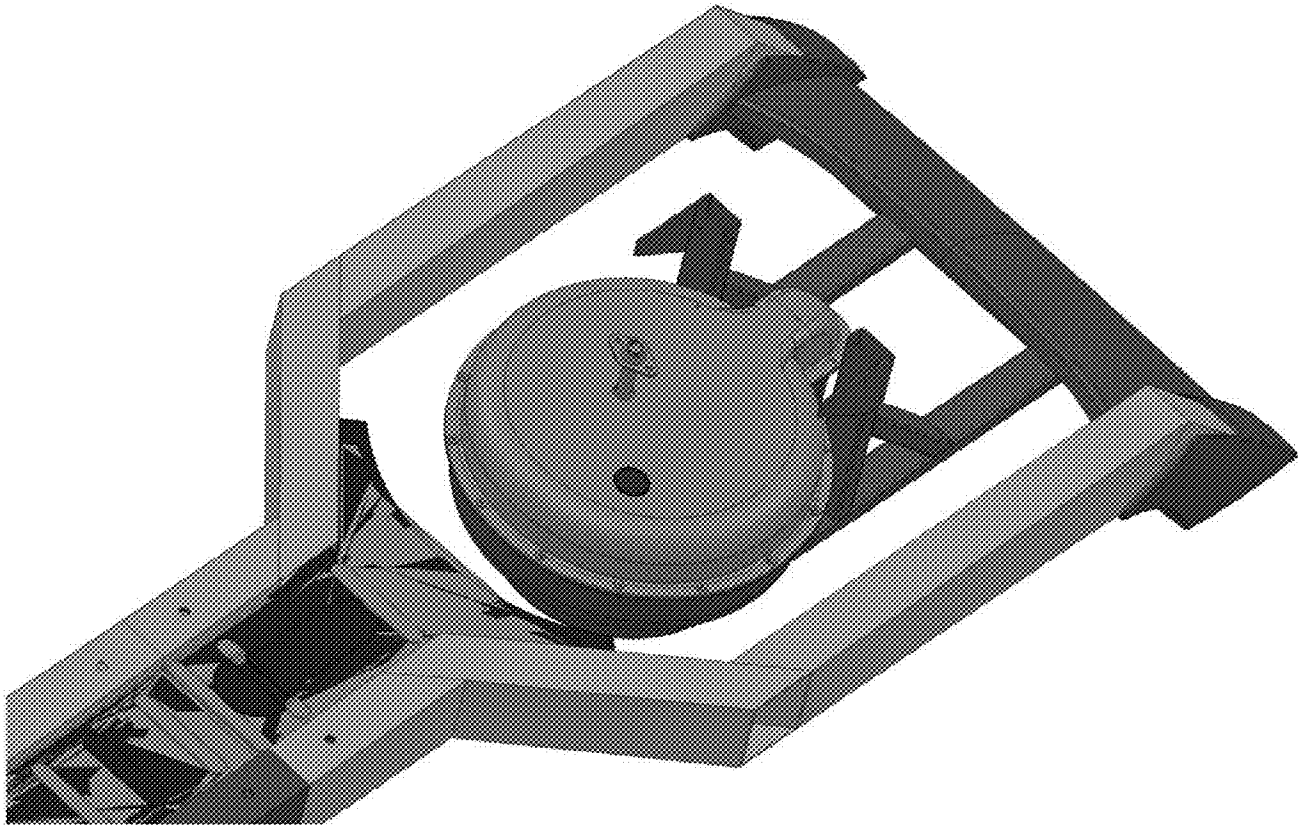

FIG. 10 comprises the view of FIG. 9 in which additional components have been omitted for clarity, whereby the shaft 902 and support framework 904 are better seen. FIG. 10 further emphasizes the connection of the support framework 904 to the support structure 20 of the exercise apparatus 10.

Figure 11:
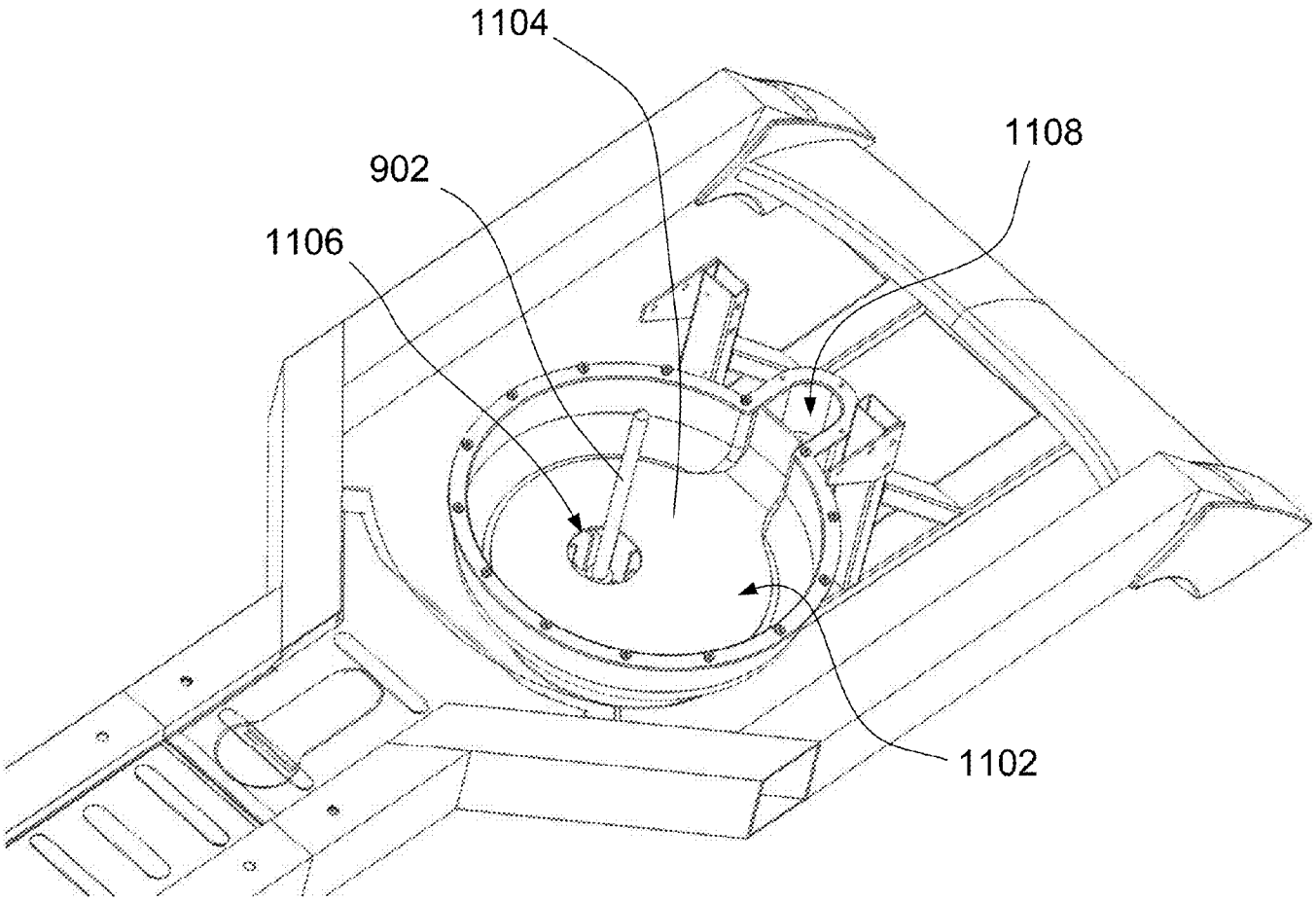
FIG. 11 comprises the view of FIG. 10 with additional components omitted.
Figure 11A:
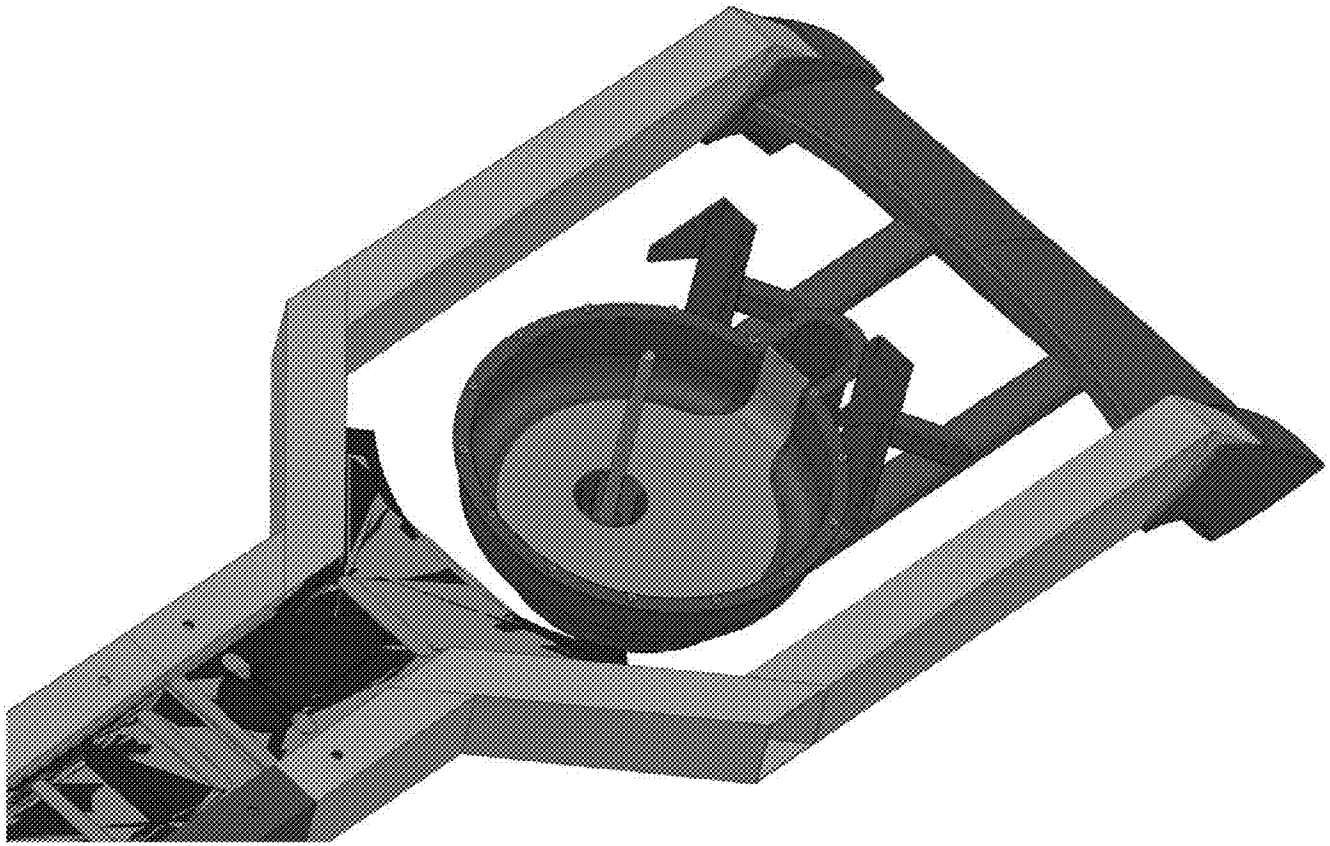

FIG. 11 comprises the view of FIG. 10 in which additional components have been omitted for clarity, whereby additional components of the exercise apparatus 10 are revealed. These additional components include an upper chamber 1102 of the pump housing; a floor 1104 of the upper chamber 1102 including an opening 1106 for the flow of fluid from the upper chamber into a lower chamber 1202 (see FIG. 12); and a passageway 1108 by which fluid is pumped from the lower chamber 1202 into the upper chamber 1102. The drive shaft 902 is also shown extending through the upper chamber 1102 into the lower chamber 1202.

Figure 12:
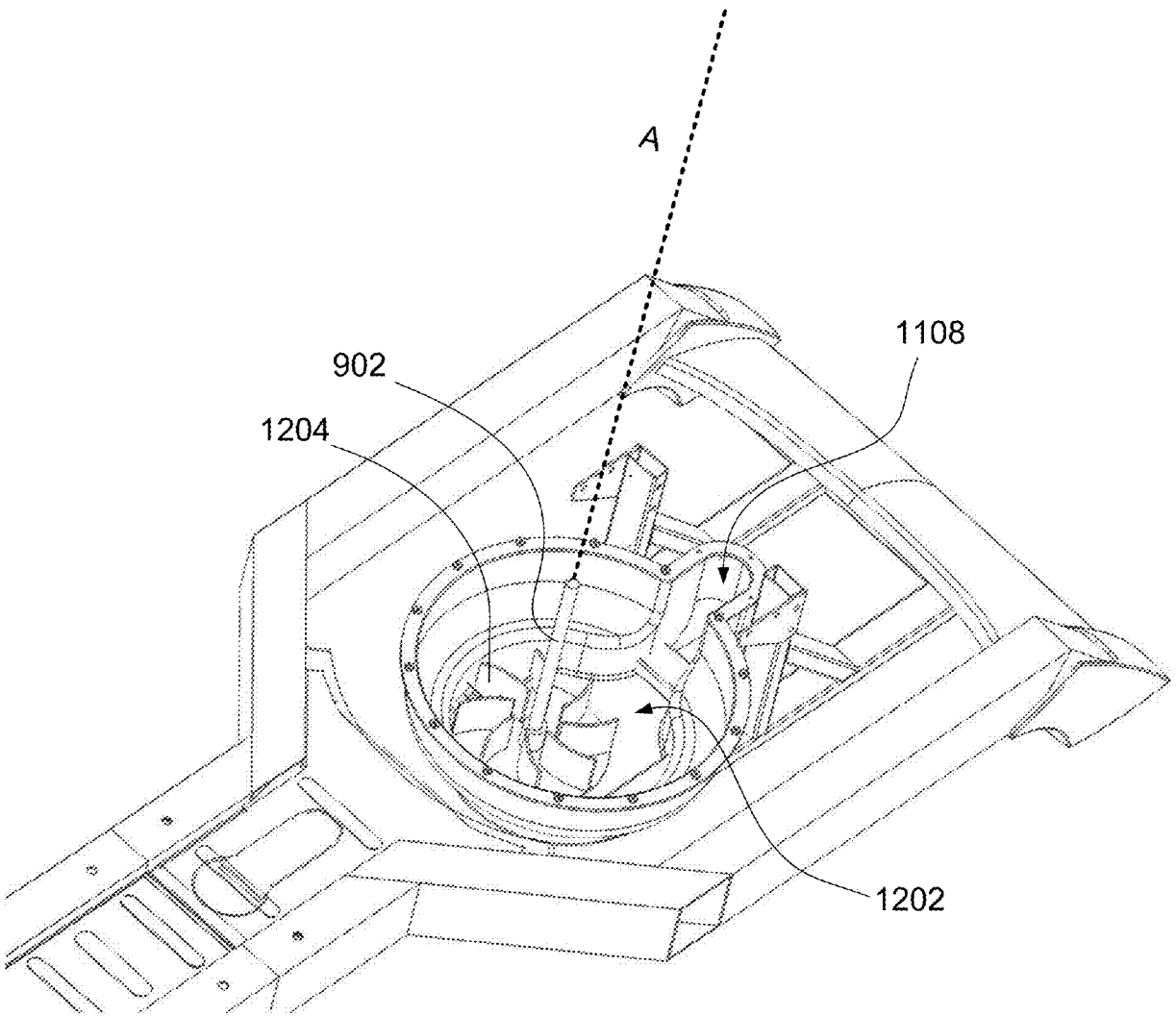
FIG. 12 comprises the view of FIG. 11 with additional components omitted.
Figure 12A:
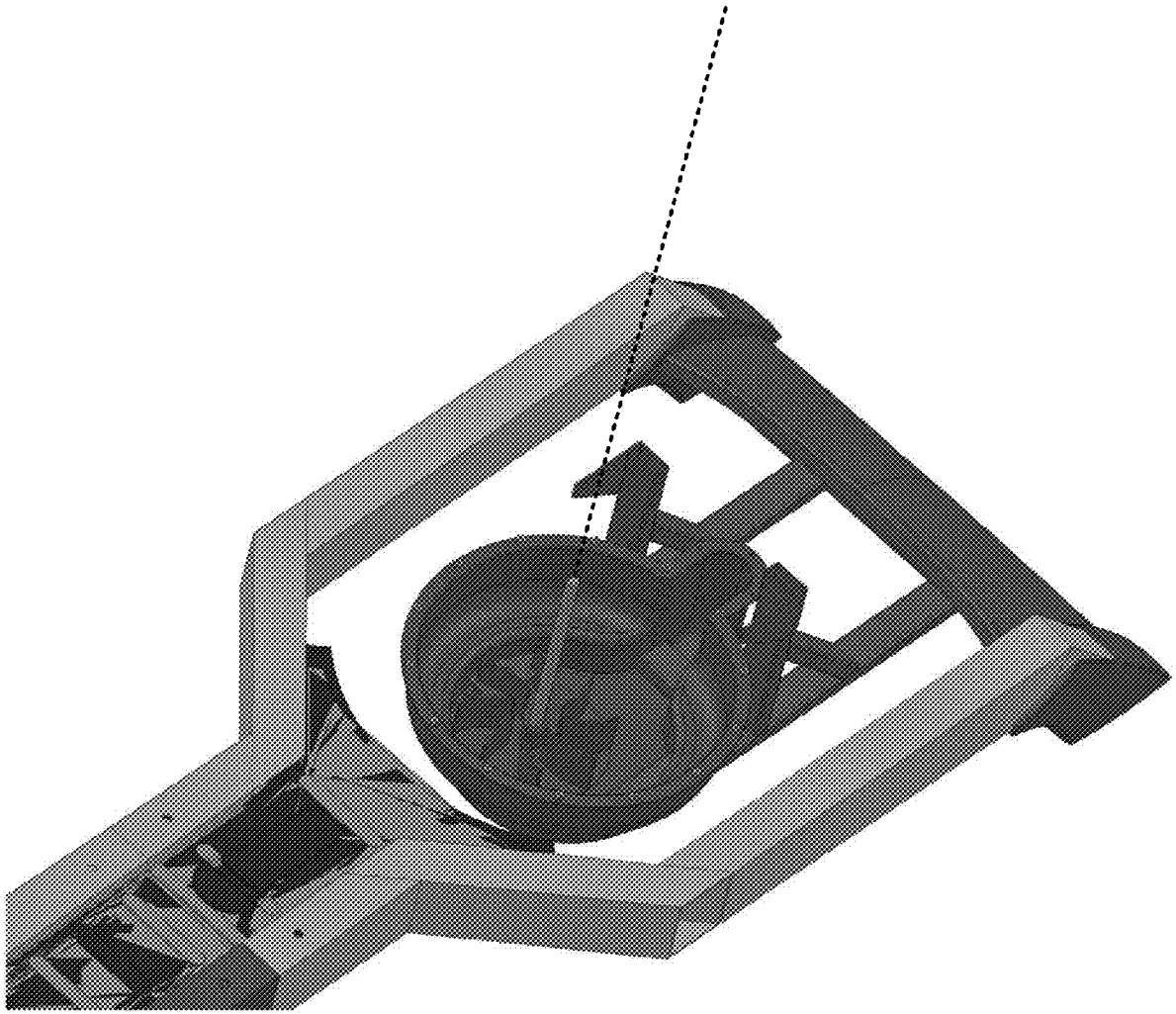

FIG. 12 comprises the view of FIG. 11 in which additional components have been omitted for clarity, whereby additional components of the exercise apparatus 10 are revealed. These additional components include a lower chamber 1202 of the pump housing and an impeller 1204 located within the lower chamber 1202 for forcing fluid up through the passageway 1108 when the impeller 1204 is driven. The drive shaft 902 is also shown connected to the impeller 1204. The axis A about which the drive shaft 902 and impeller 1204 rotate is also shown in FIG. 12.

FIGS. 1*a*-12*a* represent grayscale drawings corresponding to the black and white drawings of FIGS. 1-12, and are provided for additional clarity and perspective.

Figure 13A:
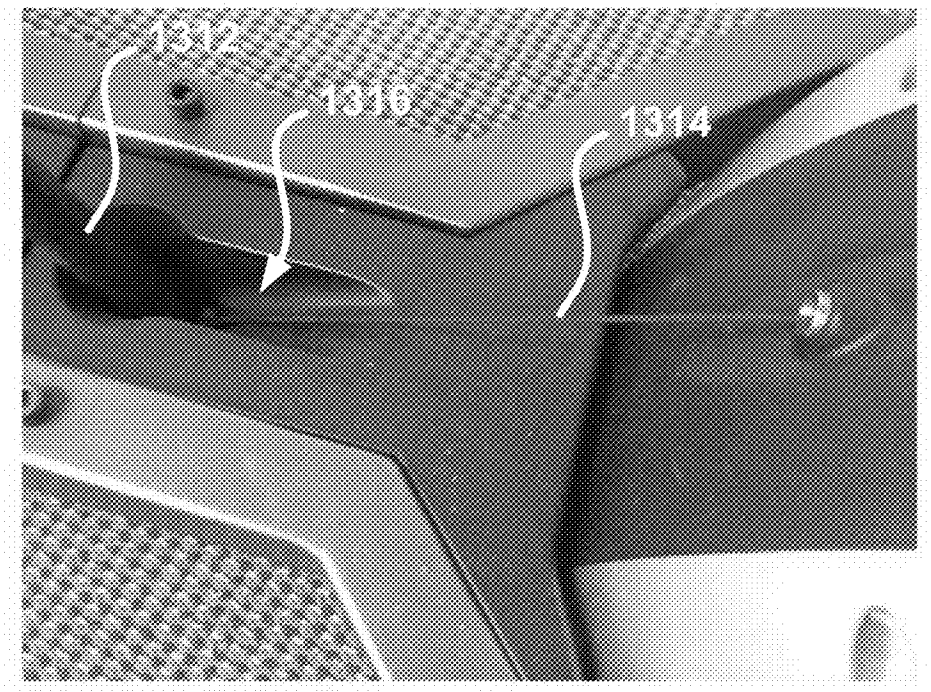
FIG. 13*a* is a perspective view of a portion of a prototype of an exercise apparatus in accordance with a preferred embodiment of the invention.
Figure 14A:
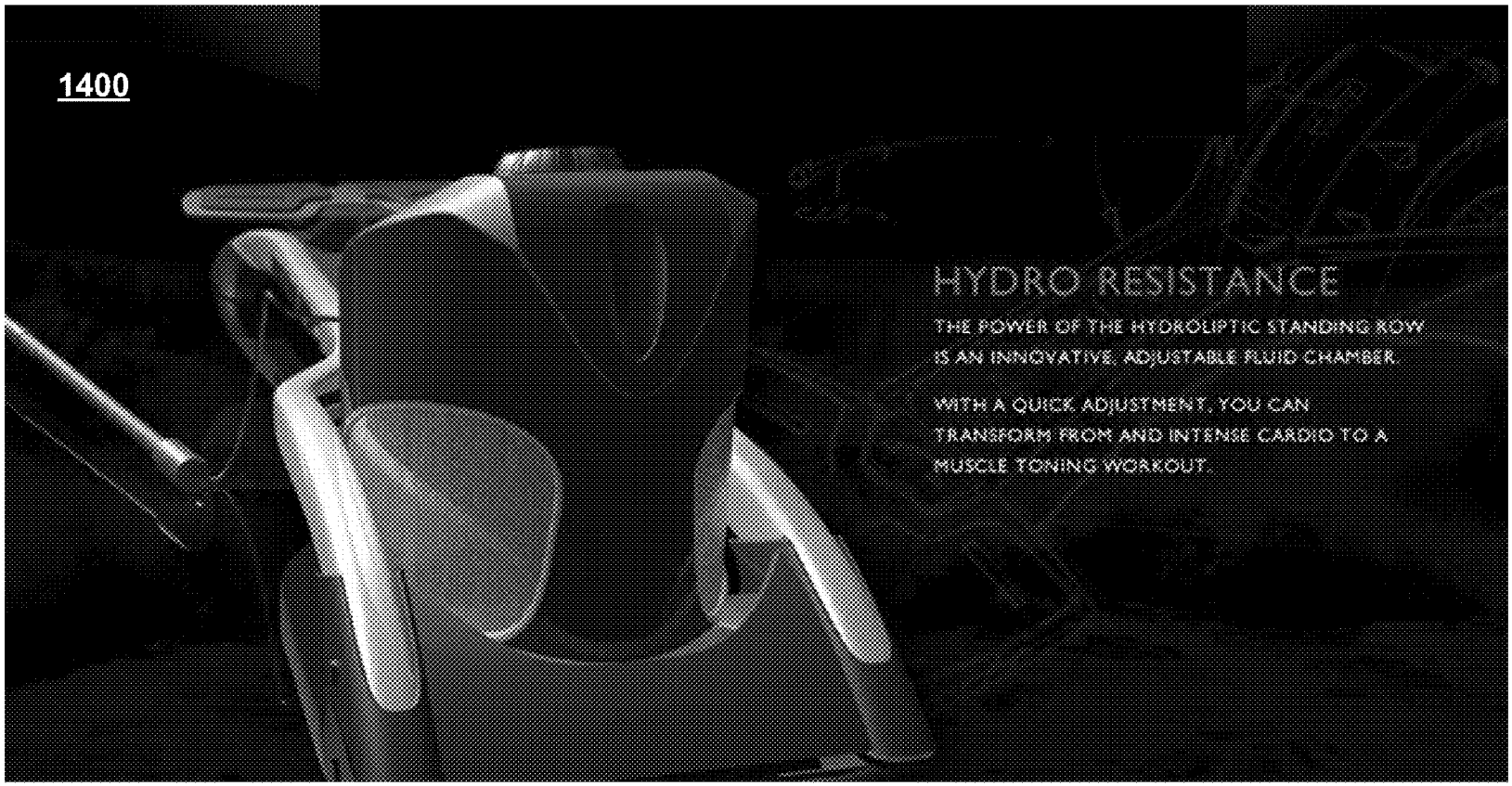
FIG. 14*a* is a perspective view of another exercise apparatus in accordance with a preferred embodiment of the invention.
Figure 15A:
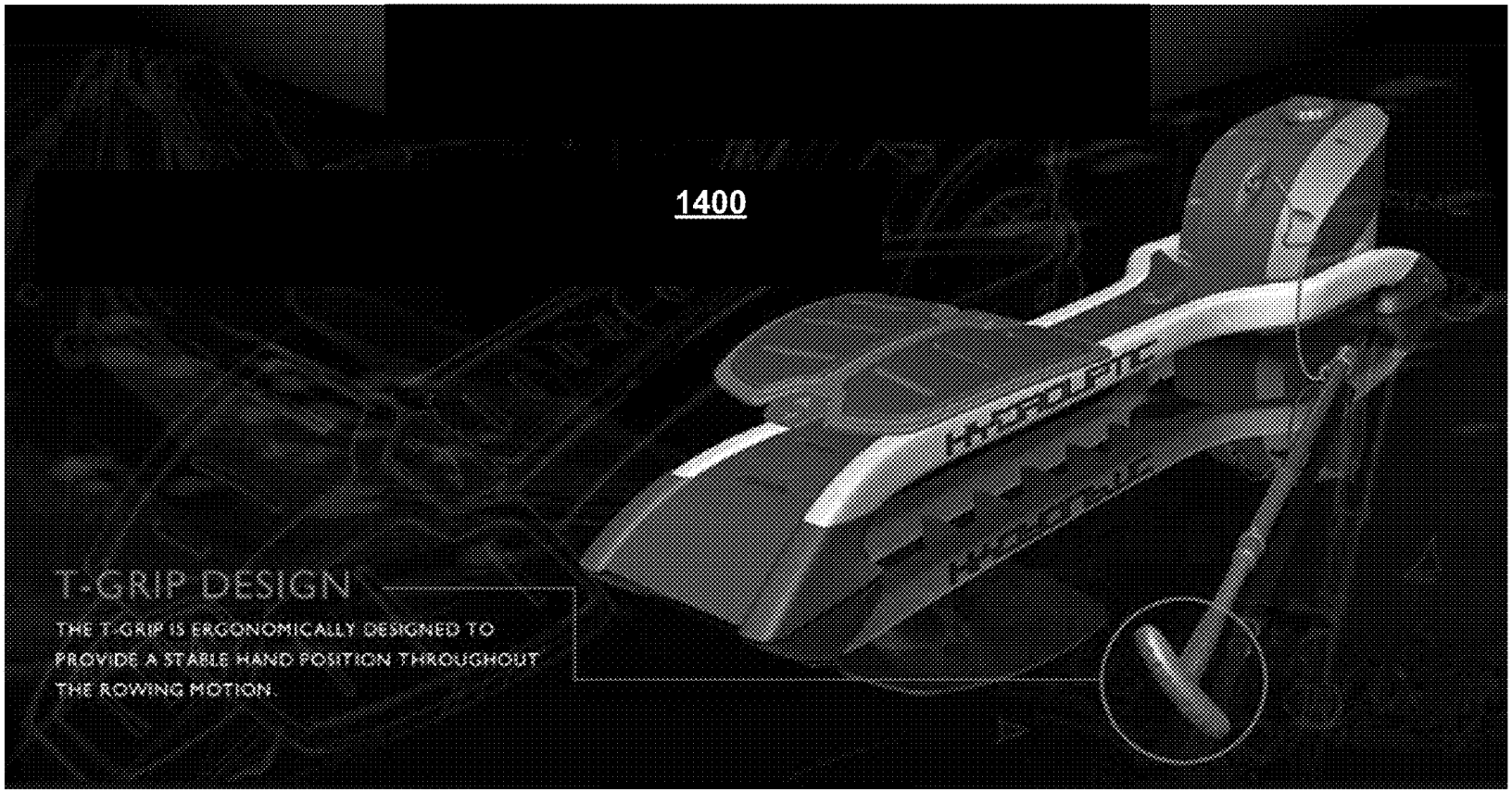
FIG. 15*a* is another perspective view of the exercise apparatus of FIG. 14*a*.
Figures 16A, 16B:
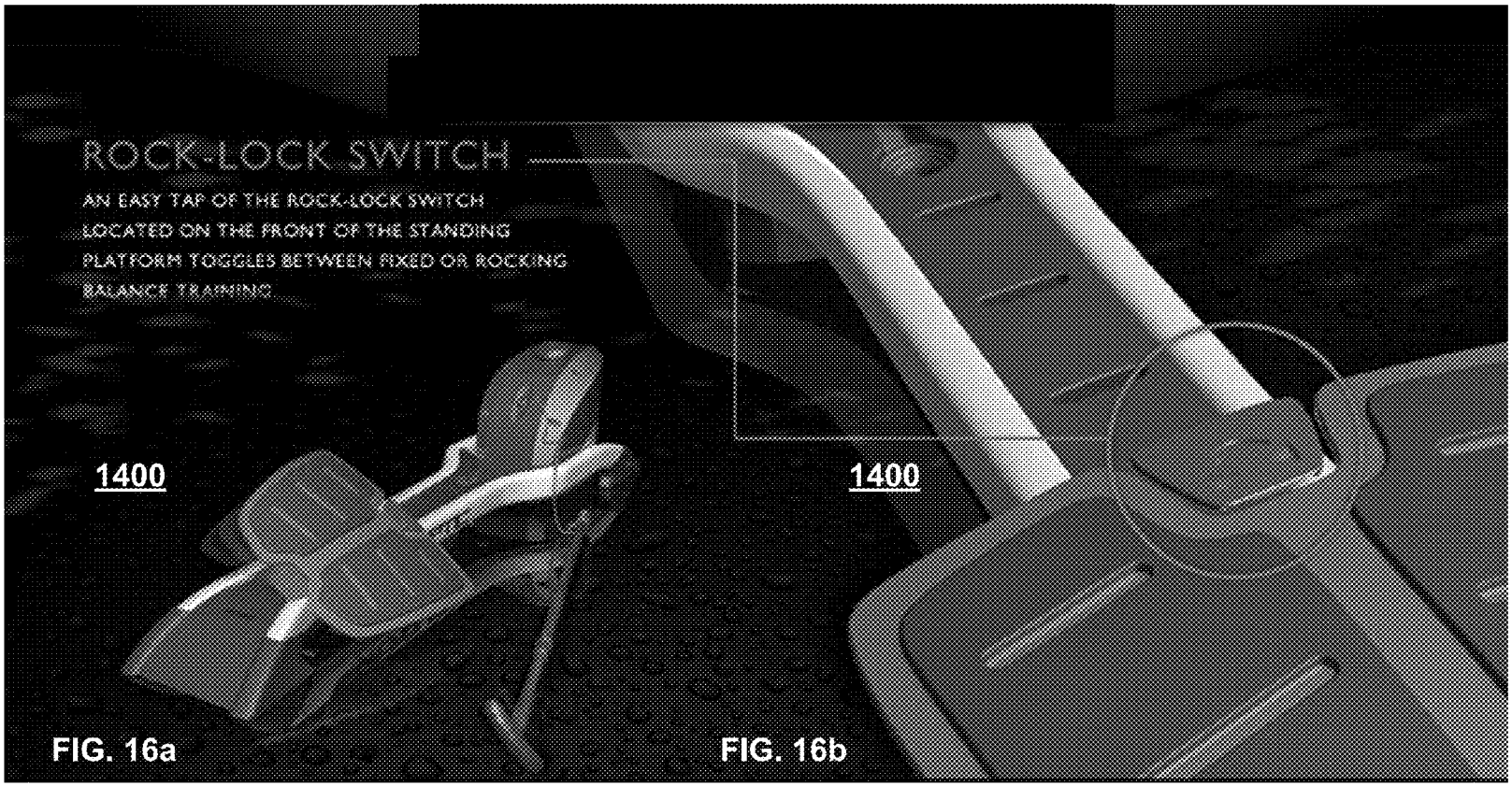
FIG. 16*a* is another perspective view up of the exercise apparatus of FIG. 14*a*.
FIG. 16*b* is another perspective view up of the exercise apparatus of FIG. 14*a*.
Figure 17A:
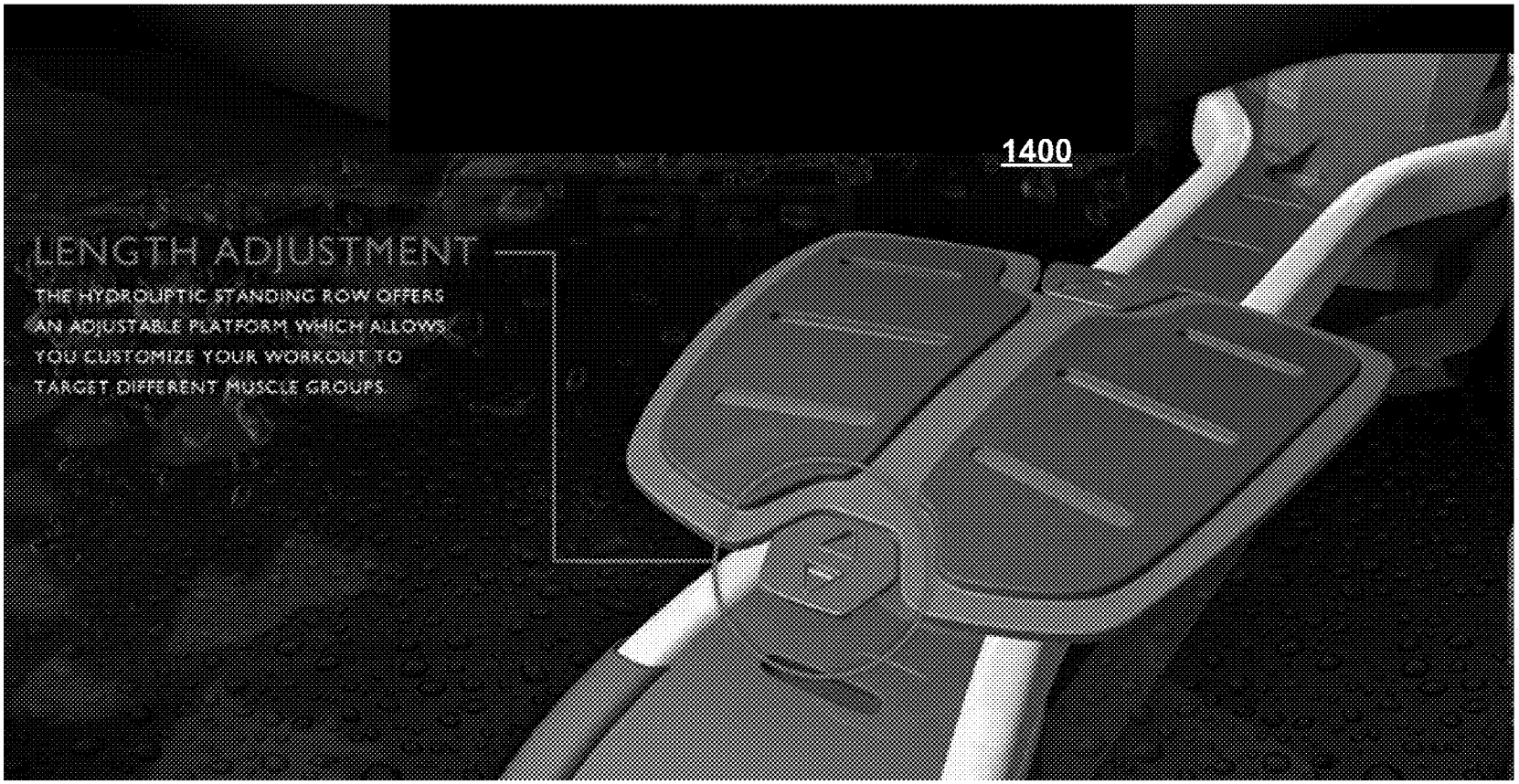
FIG. 17*a* is another perspective view of the exercise apparatus of FIG. 14*a*.
Figure 19A:
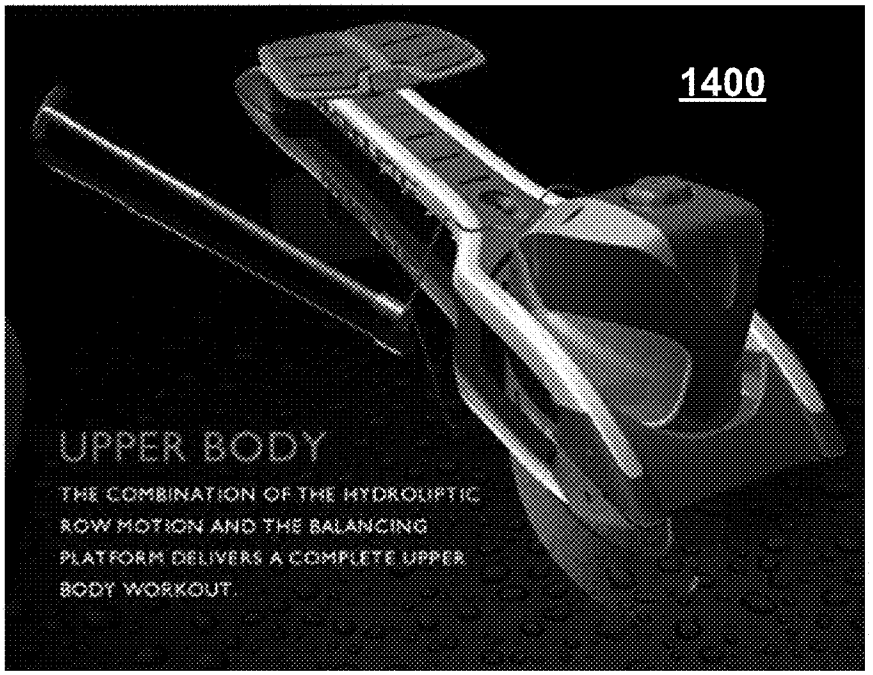
FIG. 19*a* is another perspective view of the exercise apparatus of FIG. 14*a*.
Figure 18A:
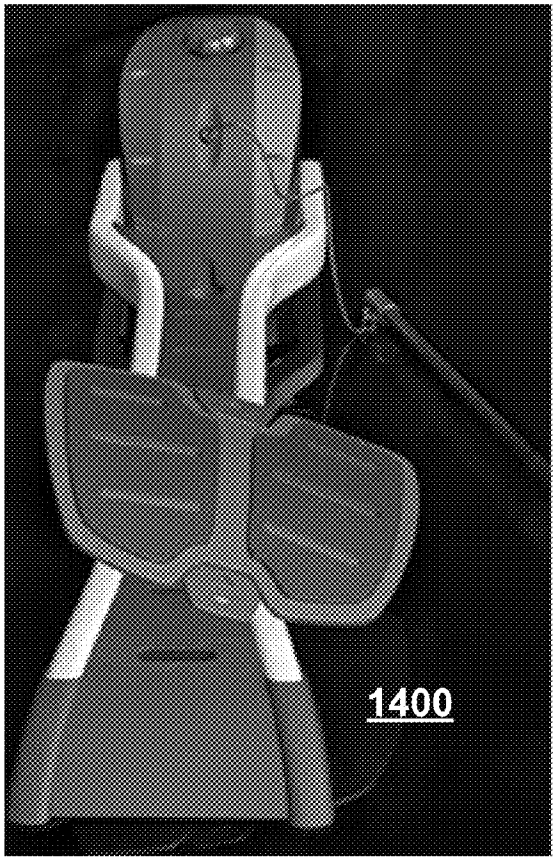
FIG. 18*a* is another perspective view of the exercise apparatus of FIG. 14*a*.
Figure 20A:
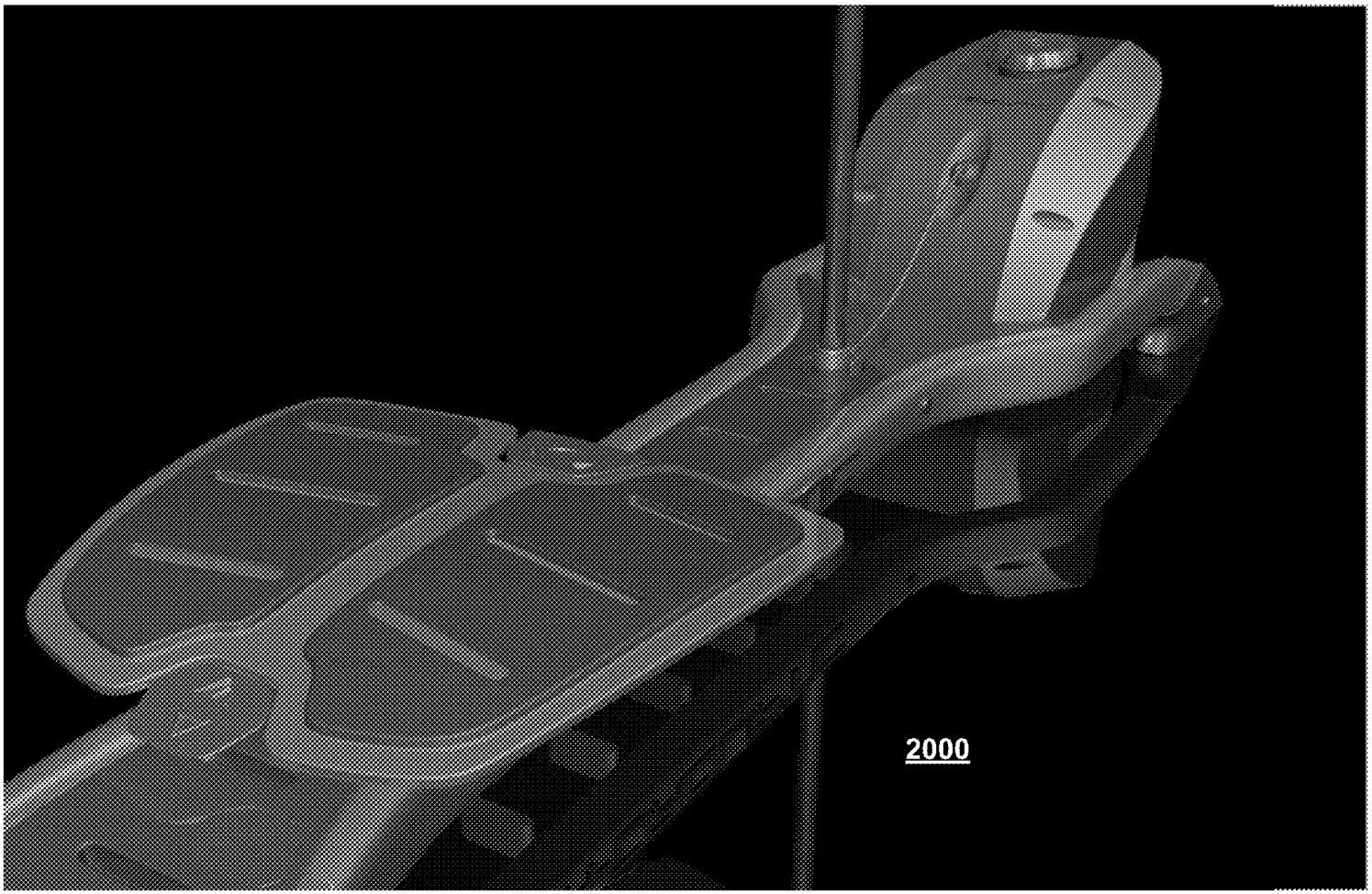
FIG. 20*a* is a perspective view of another exercise apparatus in accordance with a preferred embodiment of the invention.
Figure 21A:
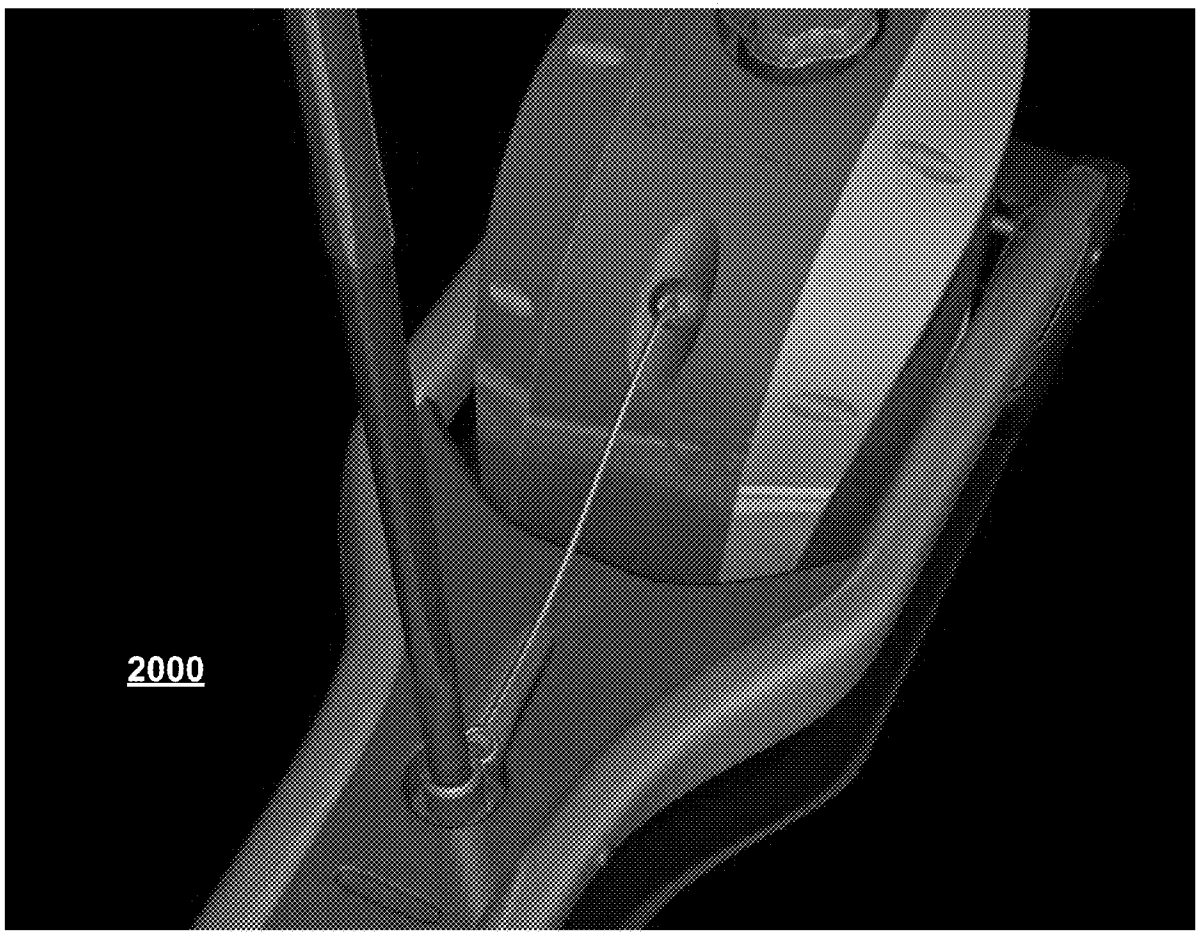
FIG. 21*a* is another perspective view of the exercise apparatus of FIG. 20*a*.
Figure 22A:
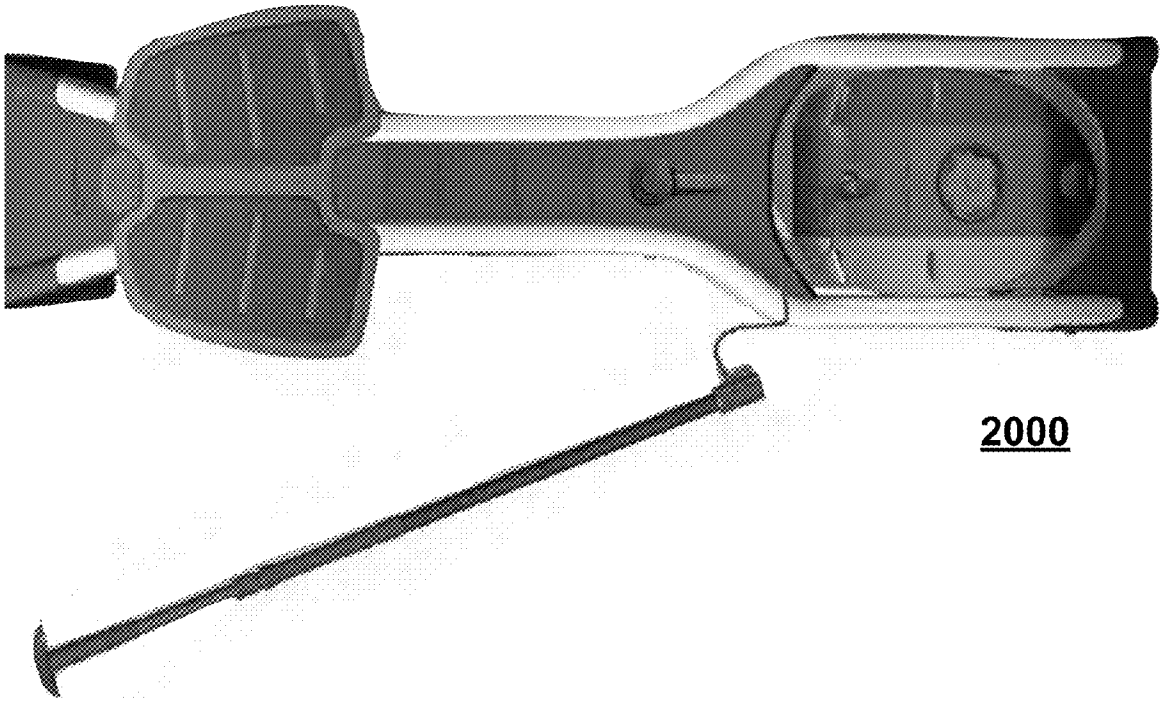
FIG. 22*a* is a top perspective view of the exercise apparatus of FIG. 20*a*.
Figure 23A:
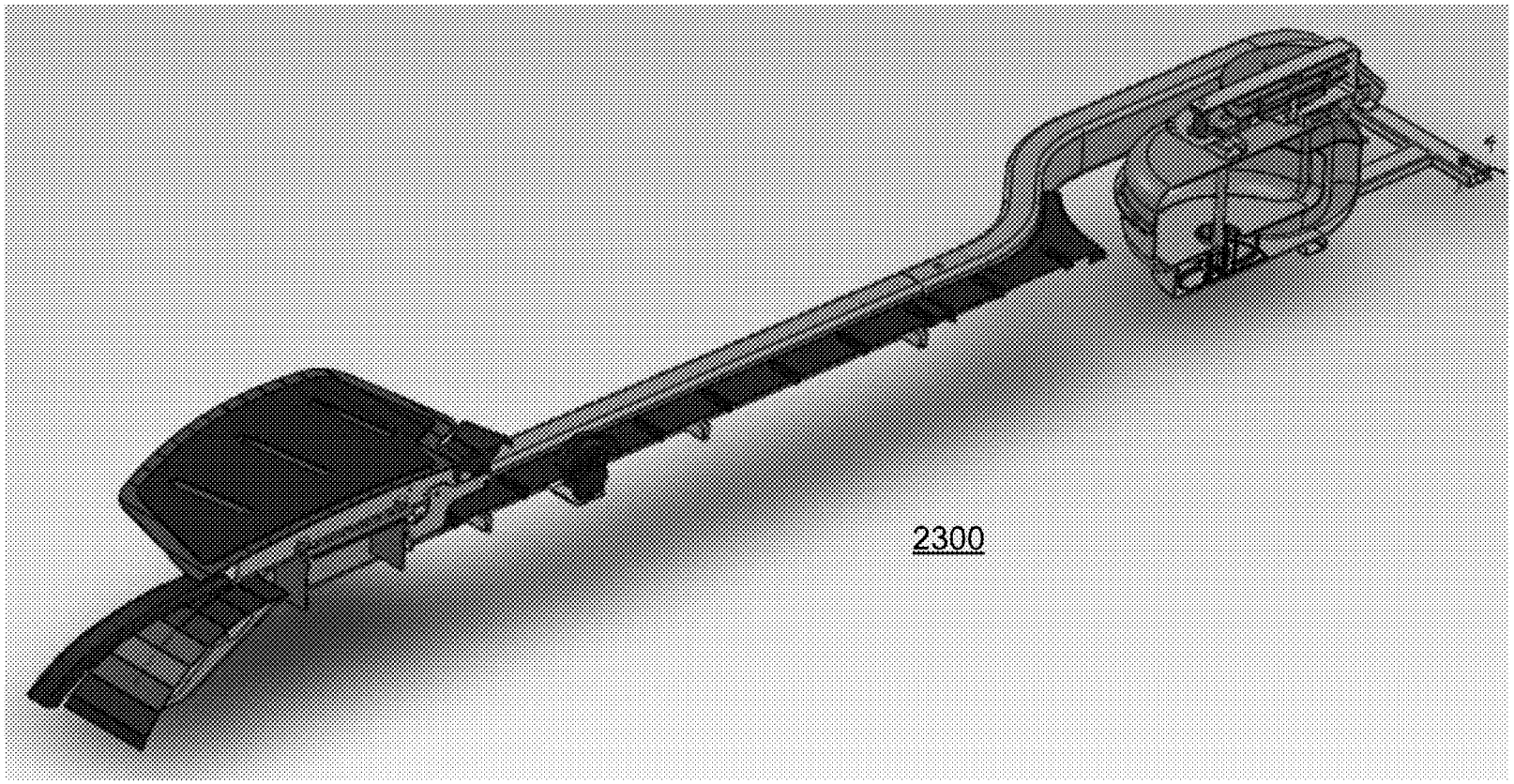
FIG. 23*a* is a perspective, cutaway view of an exercise apparatus in accordance with another preferred embodiment of the invention.

With reference to the remaining drawings not yet discussed, FIG. 13*a* is a perspective view of a portion of a prototype of an exercise apparatus in accordance with a preferred embodiment of the invention, wherein the paddle 1312 component, with tensioning line 1314 attached thereto, is shown received within a recess 1316 of the support structure for storing when the exercise apparatus is not in use; FIGS. 14*a*-19*a* are perspective views of another exercise apparatus 1400 in accordance with a preferred embodiment of the invention; and FIGS. 20*a*-22*a* are perspective views of another exercise apparatus 2000 in accordance with a preferred embodiment of the invention.

Figure 24A:
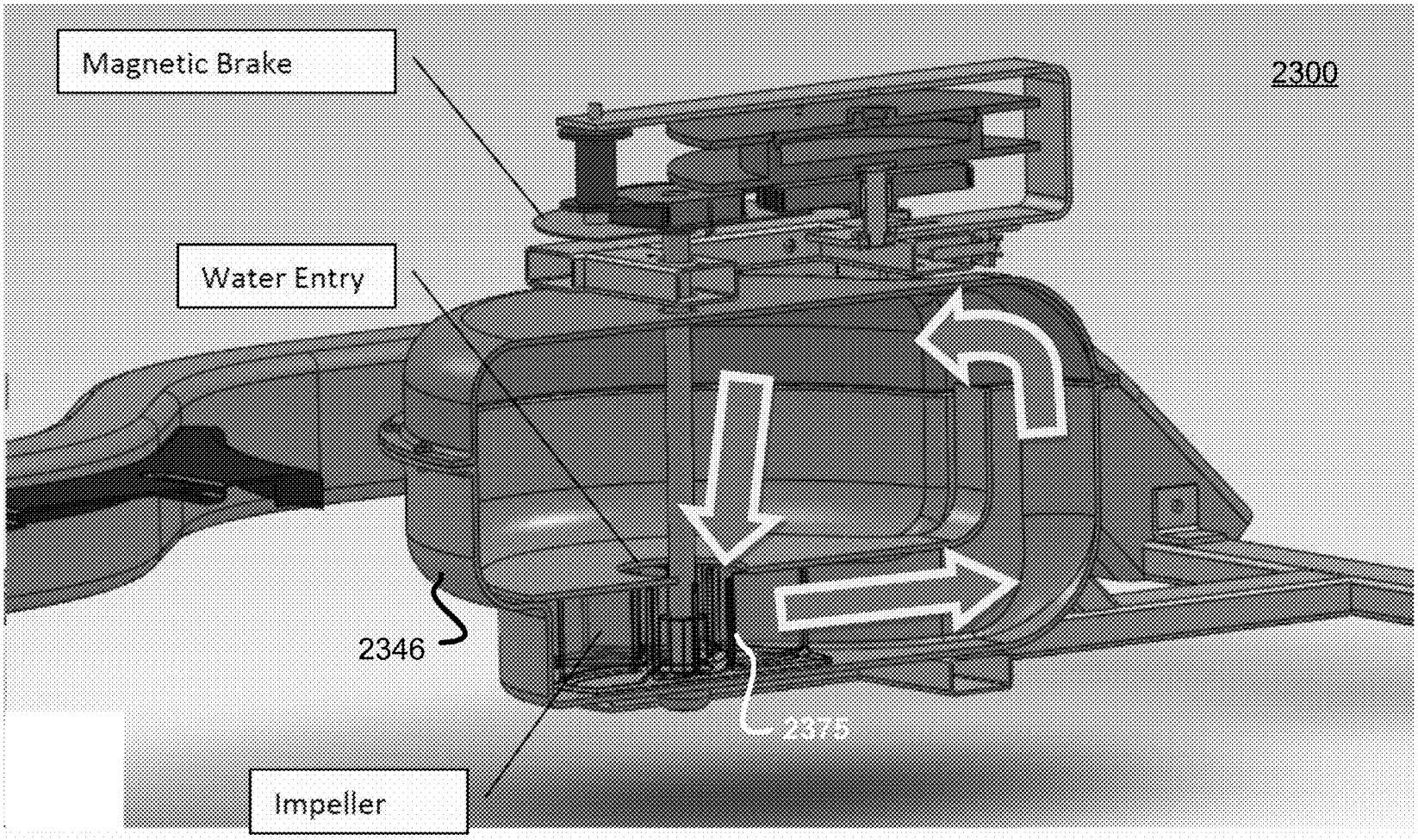
FIG. 24*a* is a perspective, cutaway view of a portion of the apparatus of FIG. 23*a*.
Figure 25A:
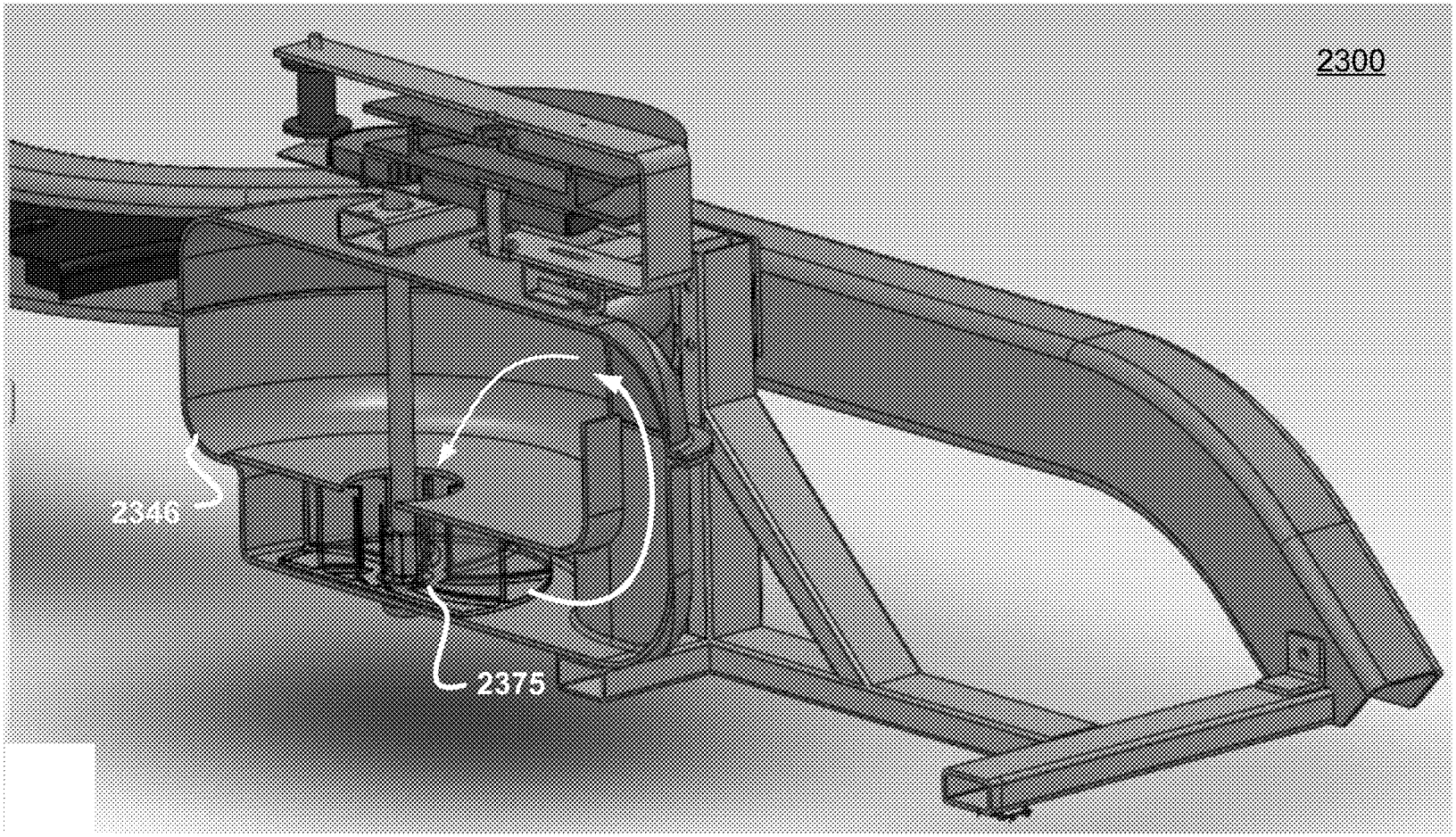
FIG. 25*a* is a perspective, cutaway view of a portion of the apparatus of FIG. 23*a*.
Figure 26A:
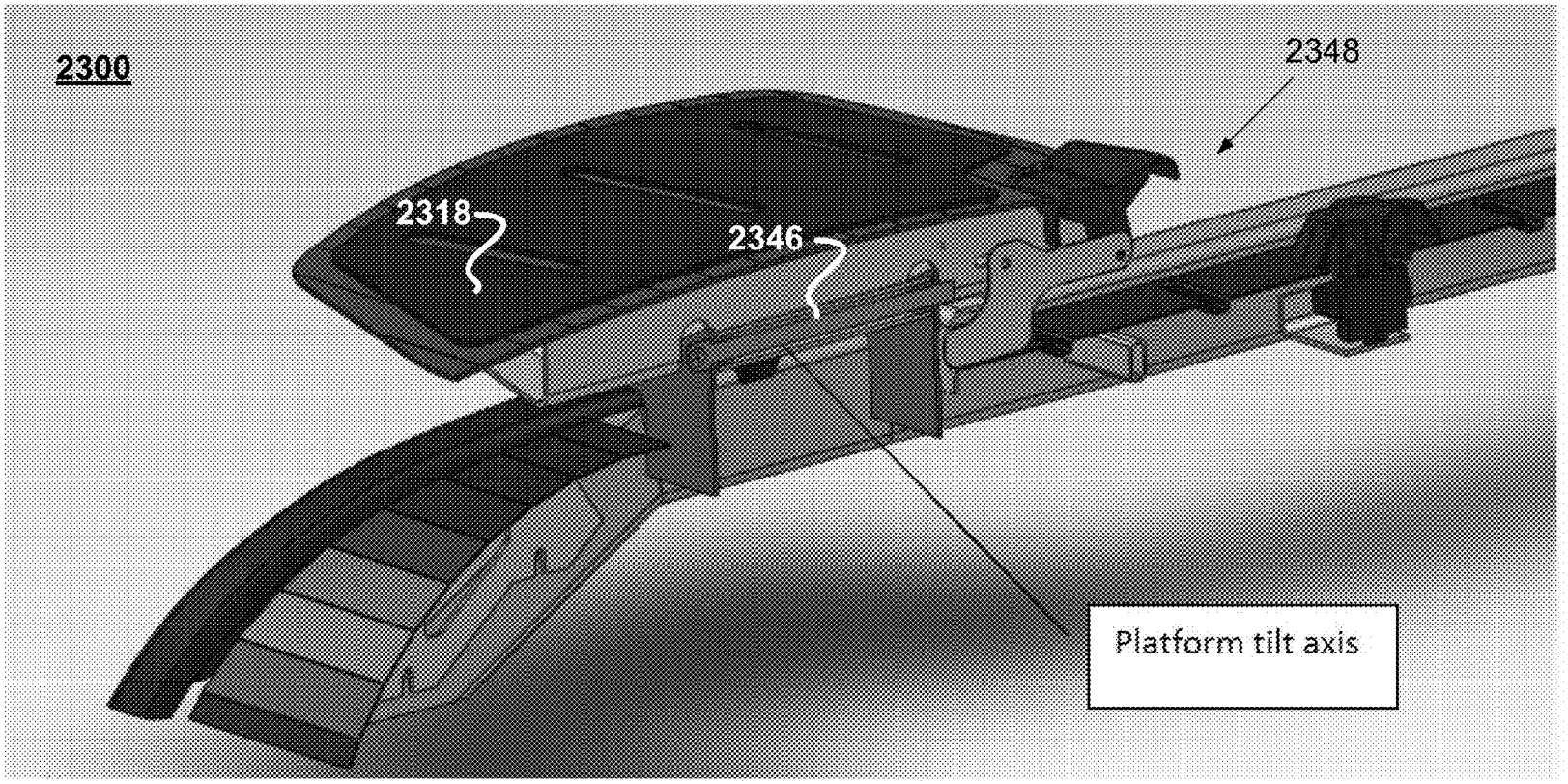
FIG. 26*a* is a perspective, cutaway view of a portion of the apparatus of FIG. 23*a*.
Figure 27A:
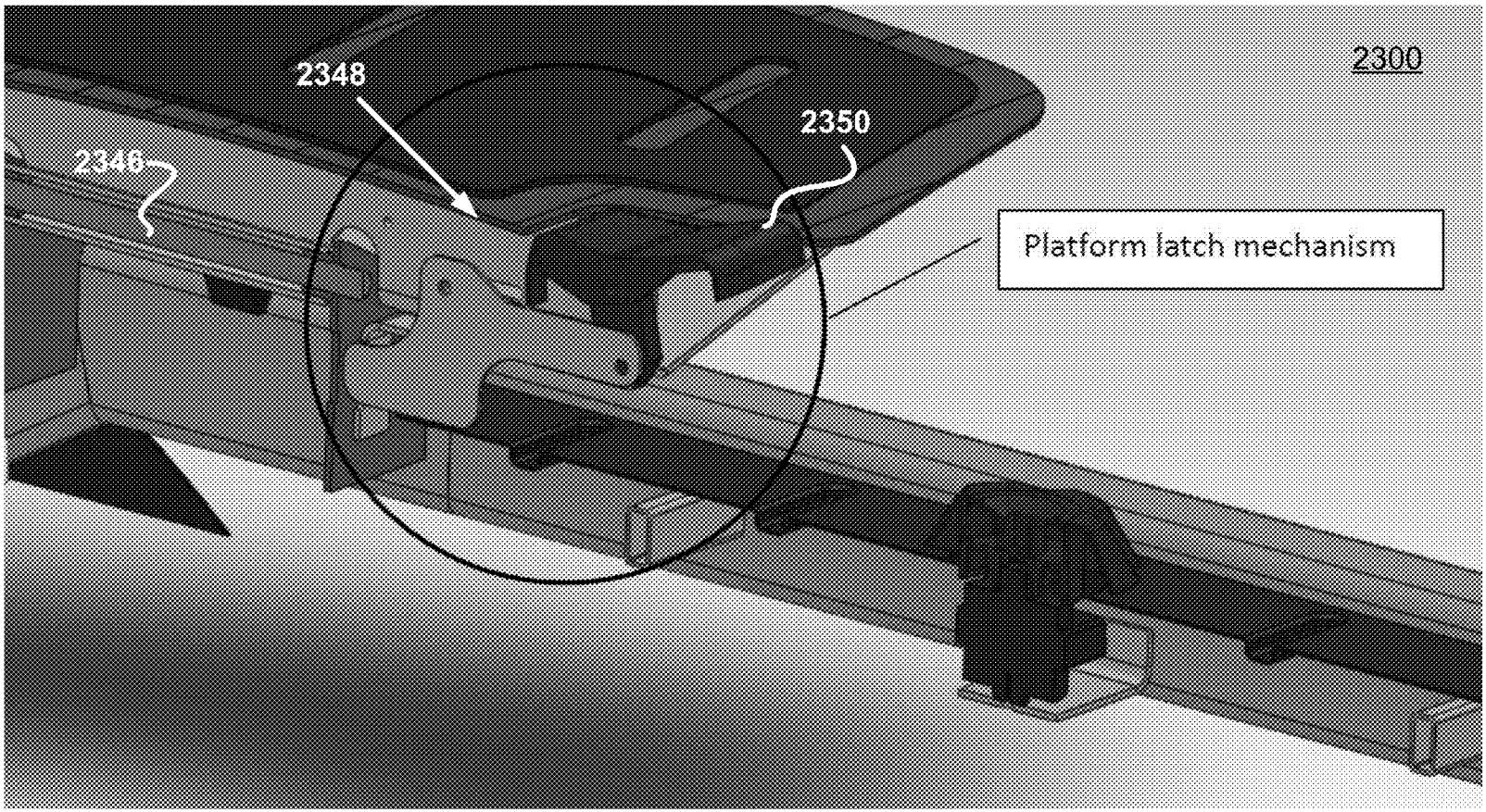
FIG. 27*a* is a perspective, cutaway view of a portion of the apparatus of FIG. 23*a*.

It will be appreciated that the fluid circulation system includes a fluid. The fluid may be water or a water-based solution. It is also contemplated that the viscosity of the fluid could be altered to provide additional baseline resistance; however, the viscosity of the fluid should not impede the recirculation of the fluid through the closed system as shown in FIG. 24*a*. Preferably, the fluid circulation system has a capacity of about three fluid gallons. In any event, the impeller preferably is submerged.

In operation of the exercise apparatus 10, for example, which is representative of the simulated paddleboarding in accordance with one or more preferred embodiments of the invention, a person stands on the platform and, while standing on the platform, handles the paddle component as if the paddle component were a paddle used in paddleboarding by manipulating the paddle component through a rowing motion including a backstroke. The resistance that is encountered during the backstroke of the rowing motion that is similar to a resistance encountered when a paddle is used in paddleboarding to propel a paddleboard. Moreover, the backstroke of the rowing motion results in the drawing out of a tensioning line of the exercise machine which, in turn, causes an impeller of the exercise machine to be driven such that a fluid is circulated through a closed system of the exercise machine. Additionally, tension is maintained in the tensioning line during the rowing motion by the spring-biasing of the spooling assembly of the exercise machine to wind-up the tensioning line. The backstroke acts in opposition to the spring-biasing of the spooling assembly, and the tensioning line is wound-up as the paddle component moves toward the housing during the rowing motion. During these steps, the platform pivots or rocks side to side, and the person must balance on the platform while manipulating the paddle component through the rowing motion.

Additional resistance to the drawing out of the tensioning line also preferably is provided by causing the magnetic disc to spin within the magnetic field as the tensioning line is unwound. In this respect, the method further includes adjusting the resistance that is provided to the drawing out of the tensioning line by changing the magnetic field through which the magnetic disk spins as the tensioning line is unwound.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. An exercise apparatus for simulating paddleboarding, comprising:

(a) an elongate support structure;

(b) a platform connected to the support structure for supporting a person standing thereon;

(c) a paddle component configured to be handled by the person standing on the platform, the paddle component comprising an elongate shaft;

(d) a tensioning line, the tensioning line including a first connector in proximity to a first end of the tensioning line, the paddle component including a second connector in proximity to a first end of the elongate shaft, the first and second connectors configured to, (i) connect together for connecting the paddle component to the tensioning line during the handling of the paddle component by the person standing on the platform, and (ii) disconnect from one another for disconnecting the paddle component from the tensioning line; and (e) a housing connected to the support structure and spaced from the platform by a longitudinal distance sufficient to permit handling of the paddle component by the person standing on the platform, the tensioning line having a second end secured within the housing, the tensioning line extending from the housing when the first and second connectors are connected and the paddle component is handled by the person standing on the platform;

(f) wherein the housing contains, (i) a spring-biased spooling assembly configured, when the first and second connectors are connected, to wind the tensioning line thereon during the handling of the paddle component by the person standing on the platform, such that tension is maintained in the tensioning line and the tensioning line is retracted into the housing when the first end of the paddle component moves toward the housing during such handling, (ii) a transmission system, and (iii) an impeller-driven fluid circulation system, the transmission system interconnecting the spring-biased spooling assembly and an impeller of the impeller-driven fluid circulation system such that extension of the tensioning line outside of the housing during such handling results in driving of the impeller and circulation of fluid within the fluid circulation system, (iv) wherein the impeller-driven fluid circulation system comprises, (A) a pump housing including an upper chamber and a lower chamber, the upper chamber having a floor including an opening for the flow of fluid from the upper chamber into the lower chamber, and (B) a passageway by which fluid is pumped from the lower chamber into the upper chamber during rotation of the impeller about a generally vertically extending axis.

2. The exercise apparatus for simulating paddleboarding of claim 1, wherein the transmission system comprises a one-way clutch assembly, whereby retraction of the tensioning line into the housing does not result in driving of the impeller.

3. The exercise apparatus for simulating paddleboarding of claim 1, wherein the spring-biased spooling assembly comprises a constant-force spring such that the constant-force spring exerts a generally constant force in opposition to unwinding of the tensioning line during extension of the tensioning line from the housing.

4. The exercise apparatus for simulating paddleboarding of claim 1, wherein the paddle component comprises, (a) a T-shaped handle at a top end of the shaft; and (b) a handle grip along an extent of the shaft between the top end and a middle of the shaft.

5. The exercise apparatus for simulating paddleboarding of claim 1, wherein the circulation system is a closed system and the fluid is recirculated through the system.

6. The exercise apparatus for simulating paddleboarding of claim 1, wherein the platform is connected to the support structure such that the platform pivots about an axis extending generally parallel to the longitudinal spacing between the platform and the housing, whereby the person standing on the platform must balance his or her weight between the left and right legs when trying to keep the platform level during the handling of the paddle component.

7. The exercise apparatus for simulating paddleboarding of claim 6, further comprising one or more resilient members with which the platform engages during pivoting of the platform such that rocking motion of the platform from side to side is cushioned.

8. The exercise apparatus for simulating paddleboarding of claim 6, further comprising a stabilizing mechanism which, when engaged, locks the platform against movement relative to the support structure.

9. The exercise apparatus for simulating paddleboarding of claim 1, further comprising an auxiliary resistance system for providing additional resistance to extension of the tensioning line outside of the housing and the consequent driving of the impeller, the auxiliary resistance system comprising a magnetic disc that is rotated through a magnetic field.

10. The exercise apparatus for simulating paddleboarding of claim 9, wherein the transmission system drives rotation of the magnetic disc, and wherein an extent of the magnetic field through which the magnetic disc is rotated is adjustable such that the resistance provided by the auxiliary resistance system is adjustable.

11. The exercise apparatus for simulating paddleboarding of claim 10, further comprising a control, wherein adjustment of the control results in adjustment of the resistance provided by the auxiliary resistance system, the control and the first end of the shaft of the paddle component configured to engage one another for adjustment of the control by the person standing on the platform.

12. The exercise apparatus for simulating paddleboarding of claim 11, wherein adjustment of the control is effected by rotation of the shaft of the paddle component about an axis of the shaft when the first end of the shaft and the control are engaged, the control including a recess configured to receive in abutting engagement therein the end of the shaft.

13. The exercise apparatus of claim 1, wherein the paddle component includes a blade.

14. The exercise apparatus of claim 1, wherein the paddle component does not include a blade.

15. An exercise apparatus for simulating paddleboarding, comprising:

(a) an elongate support structure;

(b) a platform connected to the support structure for supporting a person standing thereon;

(c) a paddle component configured to be handled by the person standing on the platform, the paddle component comprising an elongate shaft;

(d) a tensioning line, the tensioning line including a first connector in proximity to a first end of the tensioning line, the paddle component including a second connector in proximity to a first end of the elongate shaft, the first and second connectors configured to, (i) connect together for connecting the paddle component to the tensioning line during the handling of the paddle component by the person standing on the platform, and (ii) disconnect from one another for disconnecting the paddle component from the tensioning line;

(e) a housing connected to the support structure and spaced from the platform by a longitudinal distance sufficient to permit handling of the paddle component by the person standing on the platform, the tensioning line having a second end secured within the housing, the tensioning line extending from the housing when the first and second connectors are connected and the paddle component is handled by the person standing on the platform, wherein the housing contains, (i) a spring-biased spooling assembly configured, when the first and second connectors are connected, to wind the tensioning line thereon during the handling of the paddle component by the person standing on the platform, such that tension is maintained in the tensioning line and the tensioning line is retracted into the housing when the first end of the paddle component moves toward the housing during such handling, the spring-biased spooling assembly comprising a constant-force spring such that the constant-force spring exerts a generally constant force in opposition to unwinding of the tensioning line during extension of the tensioning line from the housing, (ii) a transmission system comprising a one-way clutch assembly, and (iii) an impeller-driven fluid circulation system, the transmission system interconnecting the spring-biased spooling assembly and an impeller of the impeller-driven fluid circulation system such that extension of the tensioning line outside of the housing during such handling results in driving of the impeller and circulation of fluid within the fluid circulation system, (iv) whereby retraction of the tensioning line into the housing does not result in driving of the impeller; and (f) an auxiliary resistance system for providing additional resistance to extension of the tensioning line outside of the housing and the consequent driving of the impeller, the auxiliary resistance system comprising a magnetic disc that is rotated through a magnetic field, wherein the transmission system drives rotation of the magnetic disc, and wherein extent of the magnetic field through which the magnetic disc is rotated is adjustable such that the resistance provided by the auxiliary resistance system is adjustable.

16. The exercise apparatus for simulating paddleboarding of claim 15, wherein the circulation system is a closed system and the fluid is recirculated through the system.

17. The exercise apparatus for simulating paddleboarding of claim 15, wherein the platform is connected to the support structure such that the platform pivots about an axis extending generally parallel to the longitudinal spacing between the platform and the housing, whereby the person standing on the platform must balance his or her weight between the left and right legs when trying to keep the platform level during the handling of the paddle component.

* * * * *